US009868453B2

(12) United States Patent
Johnson et al.

(10) Patent No.: US 9,868,453 B2
(45) Date of Patent: Jan. 16, 2018

(54) RAILCAR END UNIT

(71) Applicant: O-Ring Sales & Service, Inc., Lenexa, KS (US)

(72) Inventors: Kevin G. Johnson, Papillion, NE (US); Richard Uriah Ralston, Marion, IA (US); Andrew Allen Johnson, Overland Park, KS (US)

(73) Assignee: O-Ring Sales & Service, Inc., Lenexa, KS (US)

( * ) Notice: Subject to any disclaimer, the term of this patent is extended or adjusted under 35 U.S.C. 154(b) by 0 days.

(21) Appl. No.: 15/601,860

(22) Filed: May 22, 2017

(65) Prior Publication Data

US 2017/0334469 A1 Nov. 23, 2017

Related U.S. Application Data

(60) Provisional application No. 62/339,222, filed on May 20, 2016, provisional application No. 62/399,959, filed on Sep. 26, 2016.

(51) Int. Cl.

| | |
|---|---|
| ***B61G 11/10*** | (2006.01) |
| ***B61G 11/02*** | (2006.01) |
| ***B61G 9/04*** | (2006.01) |
| ***B61G 3/06*** | (2006.01) |
| *B61G 3/04* | (2006.01) |

(52) U.S. Cl.

CPC ..... *B61G 11/02* (2013.01); *B61G 3/06* (2013.01); *B61G 9/045* (2013.01); *B61G 3/04* (2013.01); *B61G 9/04* (2013.01); *B61G 11/10* (2013.01)

(58) Field of Classification Search

CPC ..... B61G 11/02; B61G 11/10; B61G 11/08; B61G 3/06; B61G 3/04; B61G 3/125; B61G 3/14; B61G 9/045; B61G 9/04; B61G 9/06; B61G 9/125; B61G 9/14

USPC ..... 213/62 R, 67 R, 44, 49, 64; 267/140.4

See application file for complete search history.

(56) References Cited

U.S. PATENT DOCUMENTS

| | | | | |
|---|---|---|---|---|
| 1,772,830 A * | 8/1930 | Hankins | B61G 9/045 | 213/30 |
| 1,935,364 A * | 11/1933 | Langen | B61G 11/02 | 213/30 |
| 2,260,532 A * | 10/1941 | Lindeman | B61G 9/14 | 213/40 D |
| 2,575,491 A | 11/1951 | Dath | | |

(Continued)

FOREIGN PATENT DOCUMENTS

GB 891952 3/1962

OTHER PUBLICATIONS

Invitation to Pay Additional Fees and, Where Applicable, Protest Fee from International Application No. PCT/US2017/033863 (dated Aug. 3, 2017).

(Continued)

*Primary Examiner* — Mark T Le

(74) *Attorney, Agent, or Firm* — Hovey Williams LLP

(57) ABSTRACT

A railcar end unit is operable to be mounted in a center sill between buff and draft sill stops. The buff and draft end bodies are configured to be shiftably mounted relative to the center sill to engage the respective sill stops and to shift axially relative to one another along a unit axis. The end unit includes a buff spring pack operably mounted between the end bodies and compressible along the unit axis from a neutral condition to a compressed condition.

23 Claims, 16 Drawing Sheets

(56) References Cited

U.S. PATENT DOCUMENTS

| | | | | |
|---|---|---|---|---|
| 2,738,078 | A | 3/1956 | Tucker | |
| 3,223,051 | A | 12/1965 | Peterson | |
| 3,661,275 | A * | 5/1972 | Randolph | B61G 7/06 213/20 |
| 6,279,765 | B1 | 8/2001 | Monaco | |
| 6,681,943 | B2 | 1/2004 | Barker et al. | |
| 8,136,683 | B2 | 3/2012 | Sprainis et al. | |
| 2002/0070189 | A1 * | 6/2002 | Barker | B61G 9/06 213/62 R |

OTHER PUBLICATIONS

Amsted Rail, End-Of-Car-Systems (copyright dated 2014) at https://www.amstedrail.com/end-car-systems.

Wabtec Corporation, Freight Car Draft Arrangements, Student Workbook, TP2009 (dated Feb. 2003) at https://www.wabtec.com/markets/freight-segment-freight-car-market/documents.

Assoc. of Amer. Railroads, Cushioning Devices, End-of-Car, Specification M-921B (dated Nov. 2012).

Assoc. of Amer. Railroads, Draft Gears With a Minimum Capacity of 36,000 FT-LB at a Reaction of 500,00 LB, Specification M-901E (dated Nov. 2012).

Assoc. of Amer. Railroads, Cushioning Pocket Identification Guide—AAR Rule 59, Standard S-181 (dated Nov. 2012).

Assoc. of Amer. Railroads, Cushioning Devices, End-Of-Car—Motor-Vehicle-Carrying, Specification M-921D (dated Nov. 2012).

International Search Report and Written Opinion from International Application No. PCT/US2017/033863 (dated Oct. 3, 2017).

* cited by examiner

RAILCAR END UNIT

RELATED APPLICATION

This application claims the benefit of U.S. Provisional Application Ser. No. 62/339,222, filed May 20, 2016, entitled RAILCAR END CUSHION, and U.S. Provisional Application Ser. No. 62/399,959, filed Sep. 26, 2016, entitled RAILCAR END CUSHION, each of which is hereby incorporated in its entirety by reference herein.

BACKGROUND

1. Field

The present invention relates generally to railcar equipment. More specifically, embodiments of the present invention concern a railcar end unit mounted in the center sill of a railcar to provide cushioning between a coupler and the center sill.

2. Discussion of Prior Art

In the rail industry, various types of railcars commonly utilize a device to isolate the car from forces applied by adjacent cars. Of particular concern are axially-oriented forces referred to as draft forces (i.e., a pulling force applied to the railcar coupler) and buff forces (i.e., a pushing force applied to the railcar coupler). Draft forces and buff forces can arise under various circumstances (e.g., when connecting or operating a set of railcars). Draft forces generally act on a set of connected railcars so that adjacent railcars are pulled away from one another. Buff forces generally act on a set of connected railcars so that adjacent railcars are pushed toward each other. The device is normally installed in a center sill of the railcar to interconnect the center sill and the railcar coupler.

Some applications require the device to provide only a relatively short cushioning stroke while other applications require a relatively longer cushioning stroke. For short stroke applications, a conventional mechanical draft gear is used to cushion the railcar against draft forces and buff forces. Draft gears commonly include one or more mechanical spring elements and a separate damping mechanism. For long stroke applications, a conventional hydraulic cushioning unit is used to cushion against draft and buff force. The cushioning unit includes a hydraulic piston and cylinder construction with compressed hydraulic fluid and compressed gas to provide a spring-and-damper system. Known cushioning units generally provide a stroke length that is significantly longer than the stroke of draft gears.

However, conventional draft gears and cushioning units have various deficiencies. For instance, the short stroke of known draft gears greatly limits the degree to which draft gears can absorb forces and isolate the railcar (and its contents) from harmful forces. Although known cushioning units provide greater stroke than draft gears, cushioning units are relatively complex and expensive. Furthermore, cushioning units are prone to leaking hydraulic fluid and/or gases. Such fluid and gas leakage greatly diminishes cushioning performance and can also produce an environmental hazard. Fluid leakage associated with cushioning units also causes significant railcar downtime and results in expensive repair costs.

SUMMARY

The following brief summary is provided to indicate the nature of the subject matter disclosed herein. While certain aspects of the present invention are described below, the summary is not intended to limit the scope of the present invention.

Embodiments of the present invention provide a railcar end unit that does not suffer from the problems and limitations of the prior art draft gears and cushioning units set forth above.

A first aspect of the present invention concerns a railcar end unit for interconnecting a center sill and a railcar coupler, wherein the end unit is operably mountable between buff and draft sill stops. The railcar end unit broadly includes buff and draft end bodies and a buff spring pack. The buff and draft end bodies are spaced apart from one another along a unit axis. The buff and draft end bodies are configured to be shiftably mounted relative to the center sill to engage the buff and draft sill stops, respectively, with the end bodies being axially shiftable toward one another during a compression event. The buff spring pack is operably mounted between the end bodies and is compressible along the unit axis from a neutral condition to a compressed condition during the compression event. The buff spring pack includes a spring component and a cushioning component, each of which is operably arranged between the end bodies so as to be resiliently compressed when the buff spring pack is in the compressed condition. The spring component includes a plurality of axially arranged disc springs. The spring and cushioning components are at least in part axially coextensive so as to be simultaneously compressible during at least part of the compression event.

A second aspect of the present invention concerns a railcar end unit operable to be mounted in a center sill between buff and draft sill stops to interconnect the center sill and a coupler, with the coupler being shiftable from a neutral condition to a buff condition, in response to a buff event, and from the neutral condition to a draft condition, in response to a draft event. The railcar end unit broadly includes buff and draft end bodies, a buff spring pack, and a draft spring pack. The end bodies are configured to be shiftably mounted in the center sill to engage respective sill stops and to shift axially relative to one another along a unit axis. The draft end body is configured to connect to the coupler. The buff spring pack and the draft spring pack are each operably coupled to at least one of the end bodies. At least the buff spring pack is axially compressed along the unit axis when the coupler is in the buff condition to urge the coupler toward the neutral condition. At least the draft spring pack is resiliently compressed along the unit axis when the coupler is in the draft condition to urge the coupler toward the neutral condition. The buff draft spring pack presents an axial length which is reduced when the buff spring pack is compressed so as to permit the end bodies to move toward one another along an axial buff travel dimension. The buff travel dimension ranges from about ten inches to about eighteen inches.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the present invention will be apparent from the following detailed description of the embodiments and the accompanying drawing figures.

BRIEF DESCRIPTION OF THE DRAWING FIGURES

Preferred embodiments of the invention are described in detail below with reference to the attached drawing figures, wherein.

Figure 2:
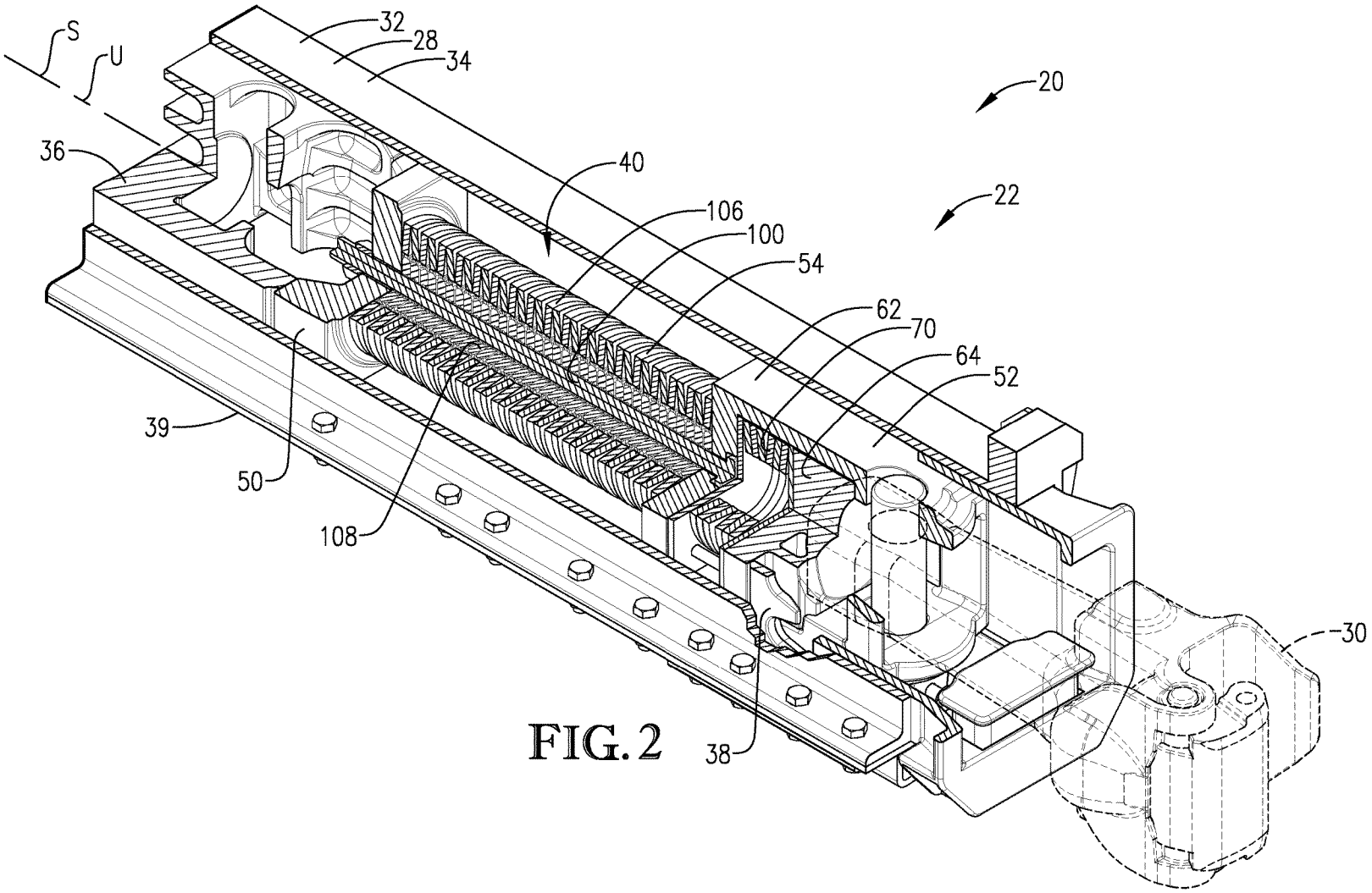
FIG. 2 is a fragmentary perspective of the railcar shown in FIG. 1, showing the center sill of the under frame and the railcar end unit mounted in a pocket of the center sill between a buff sill stop and a draft sill stop, and further showing the coupler attached to the end unit.
Figure 7:
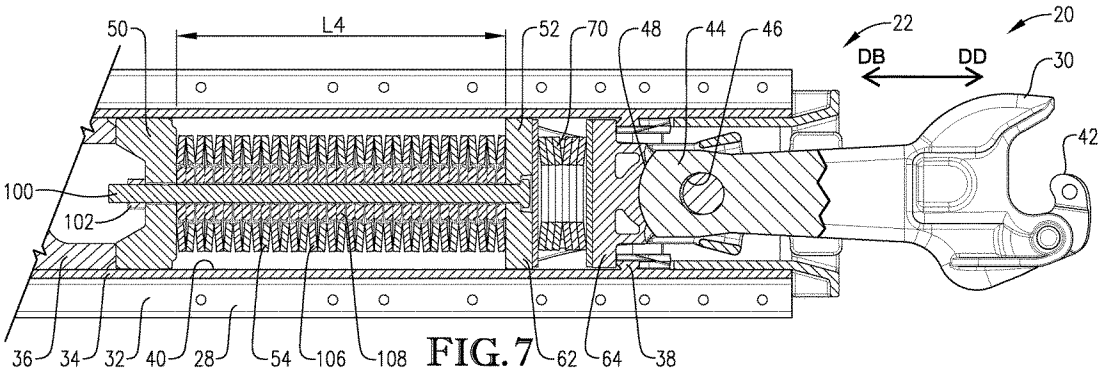
FIG. 7 is a fragmentary top view of the railcar end unit, center sill, and coupler shown in FIG. 2, with the end unit, center sill, and coupler being in a neutral condition and cross sectioned to show the buff spring pack and the draft spring pack.
Figure 8:
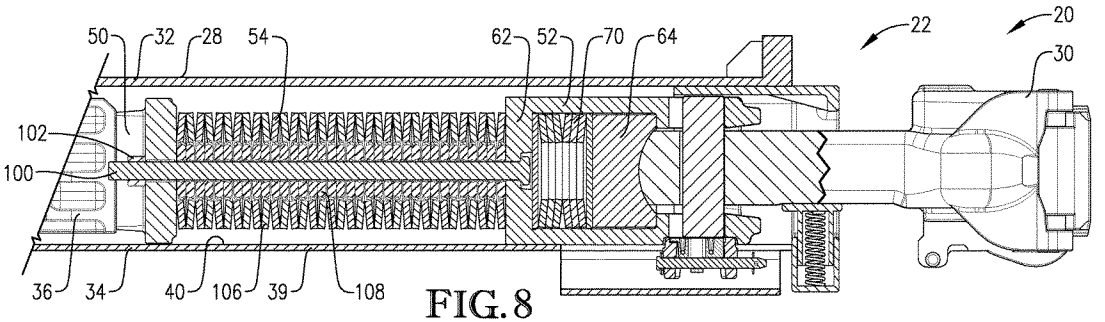
Figure 7A:
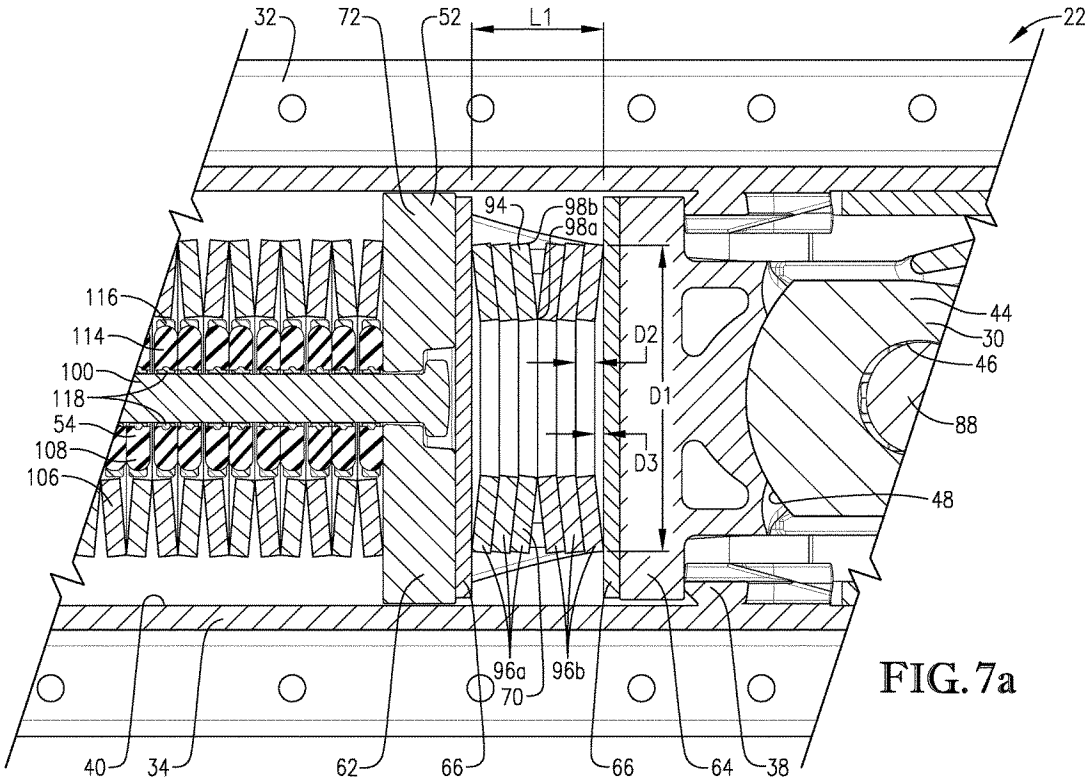
Figure 7B:
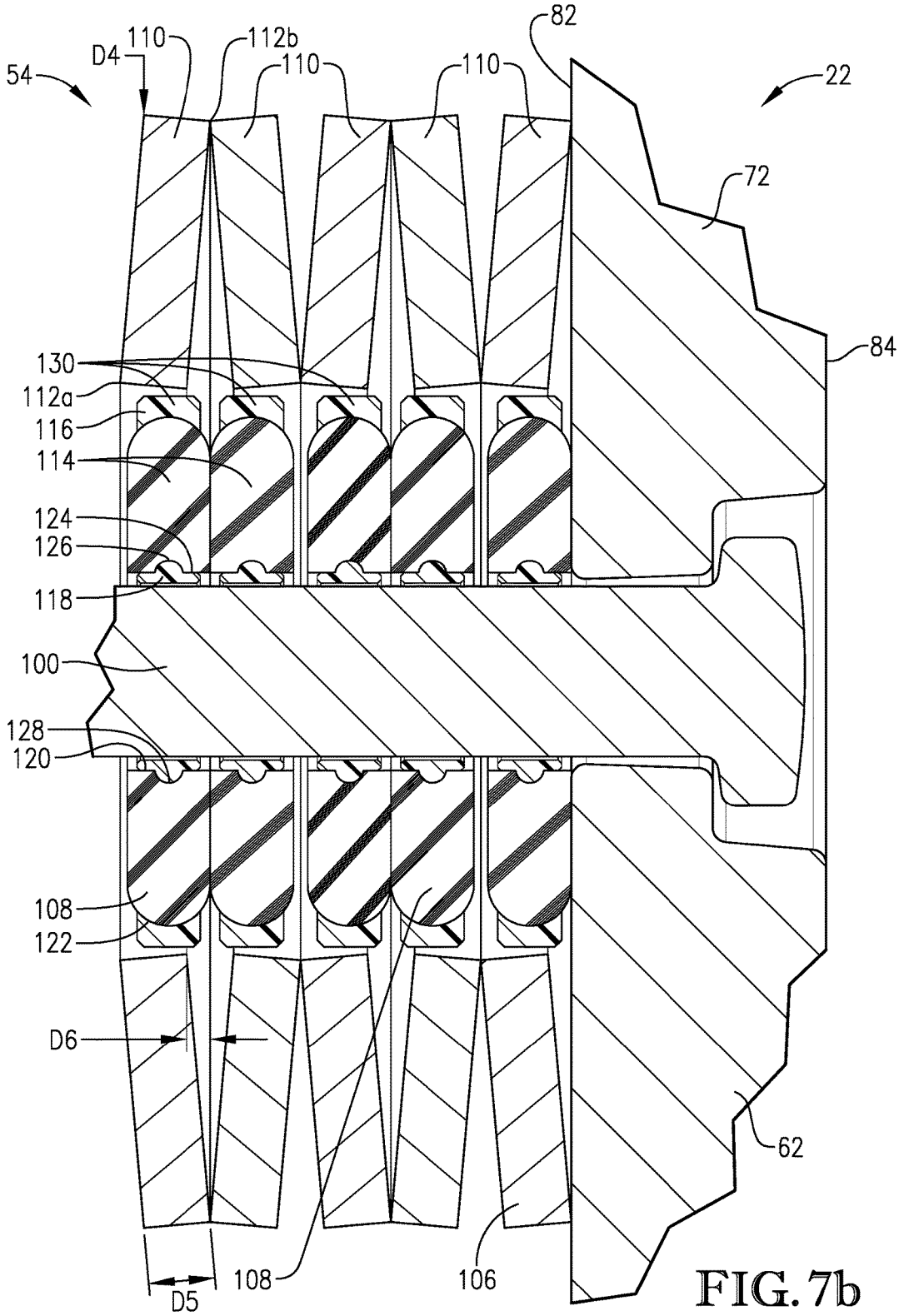
Figure 9:
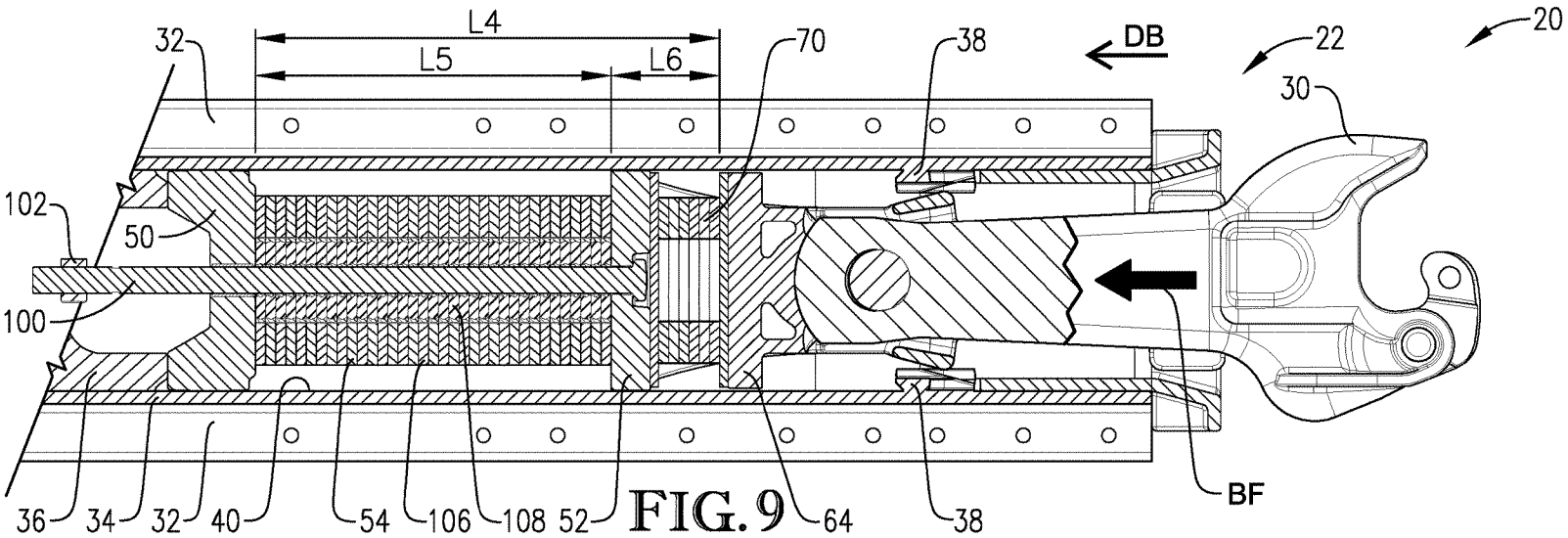
Figure 10:
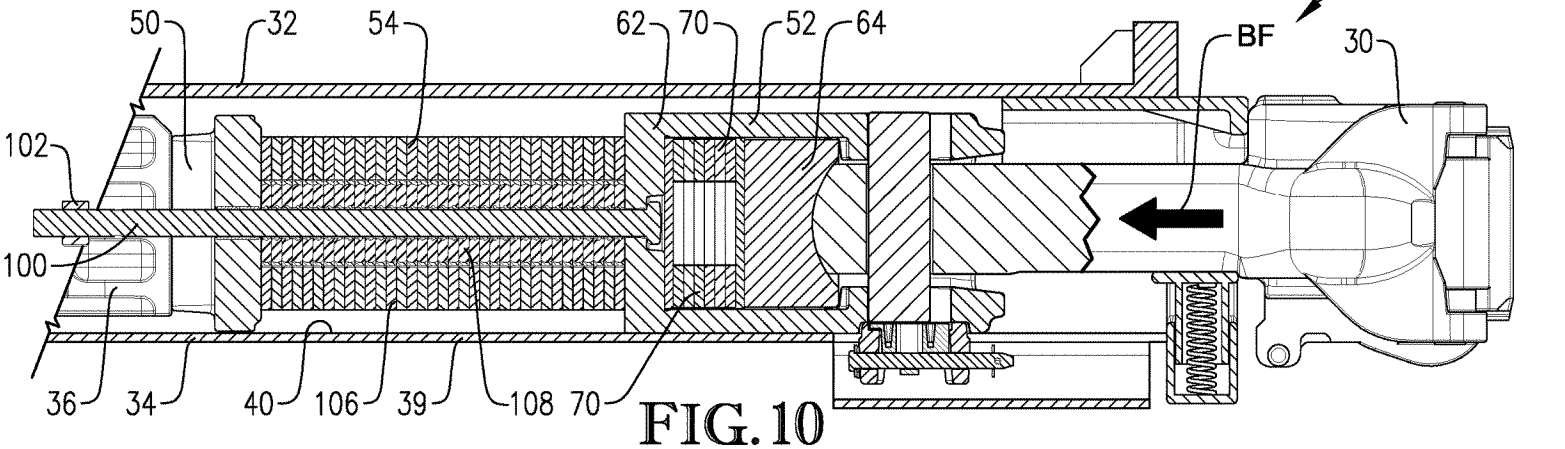
Figure 9A:
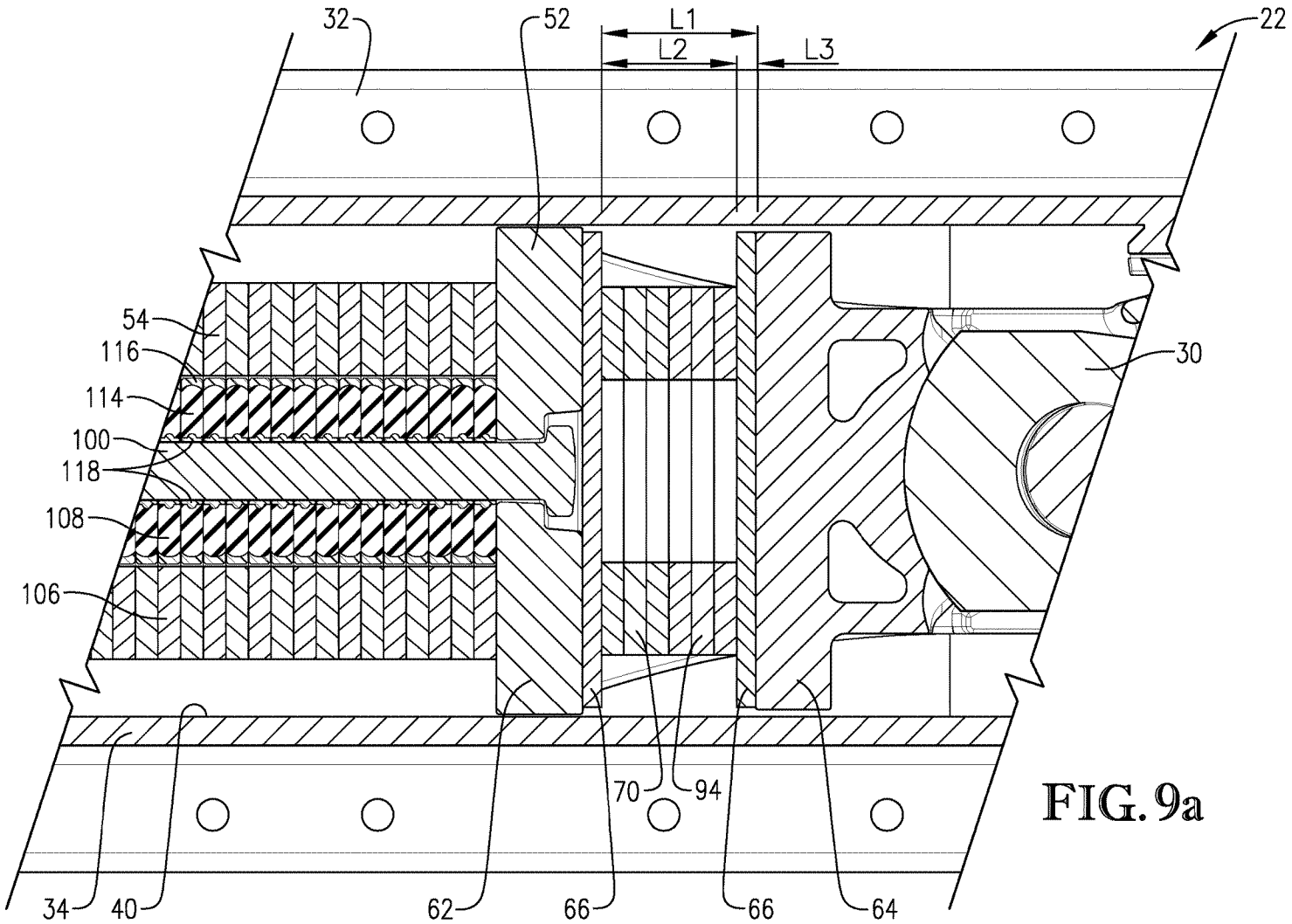
Figure 9B:
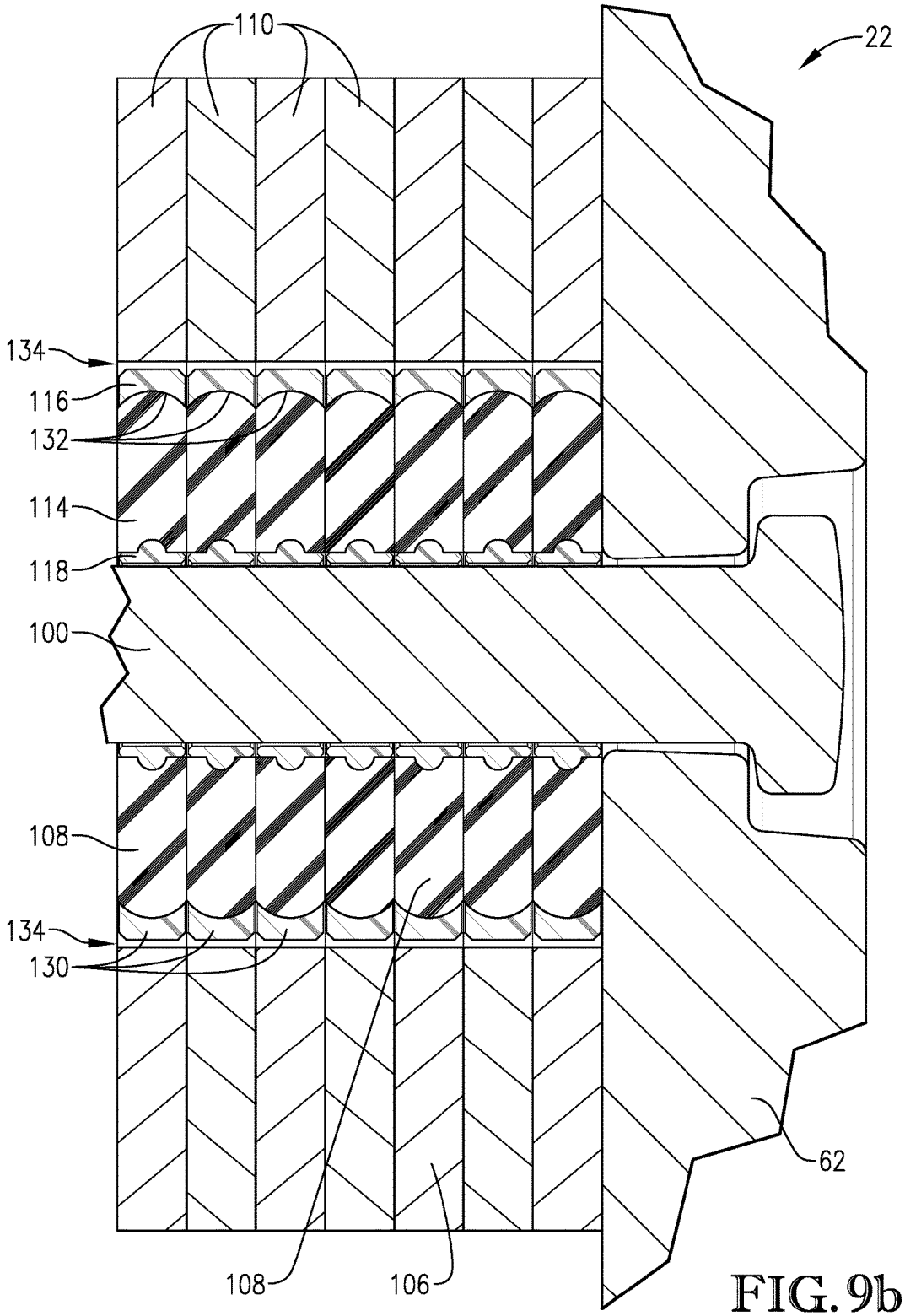
Figure 11:
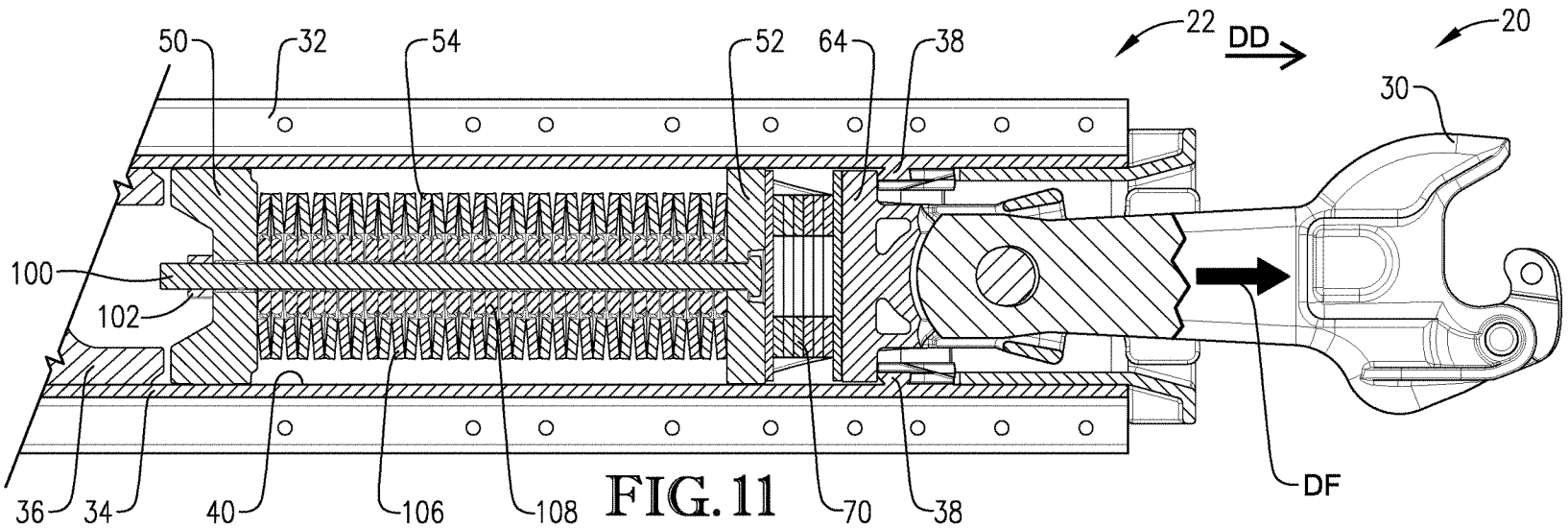
Figure 12:
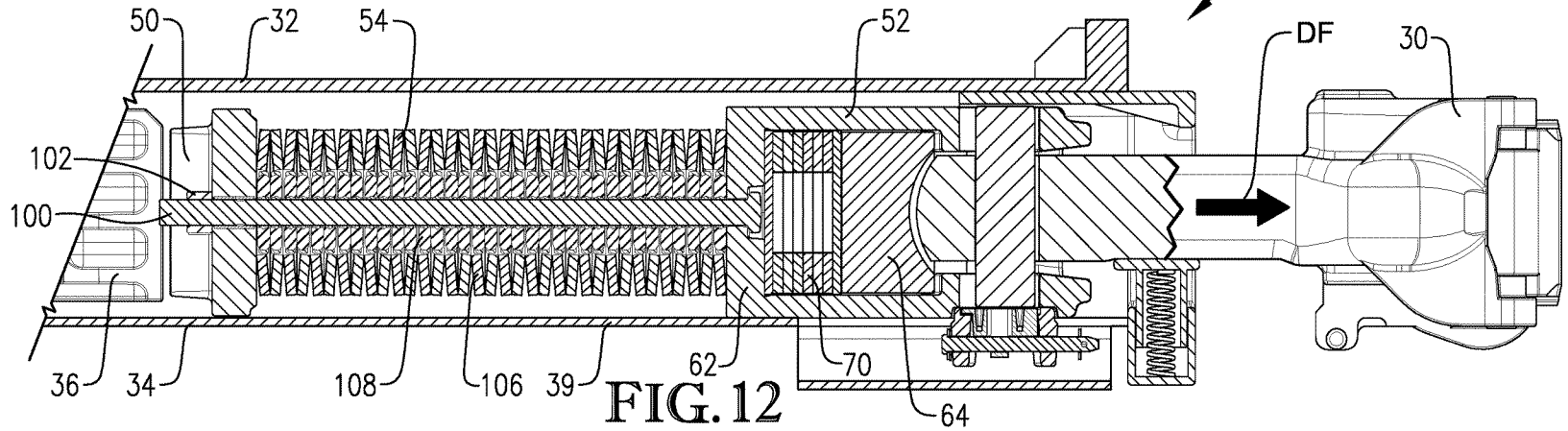
Figure 13:
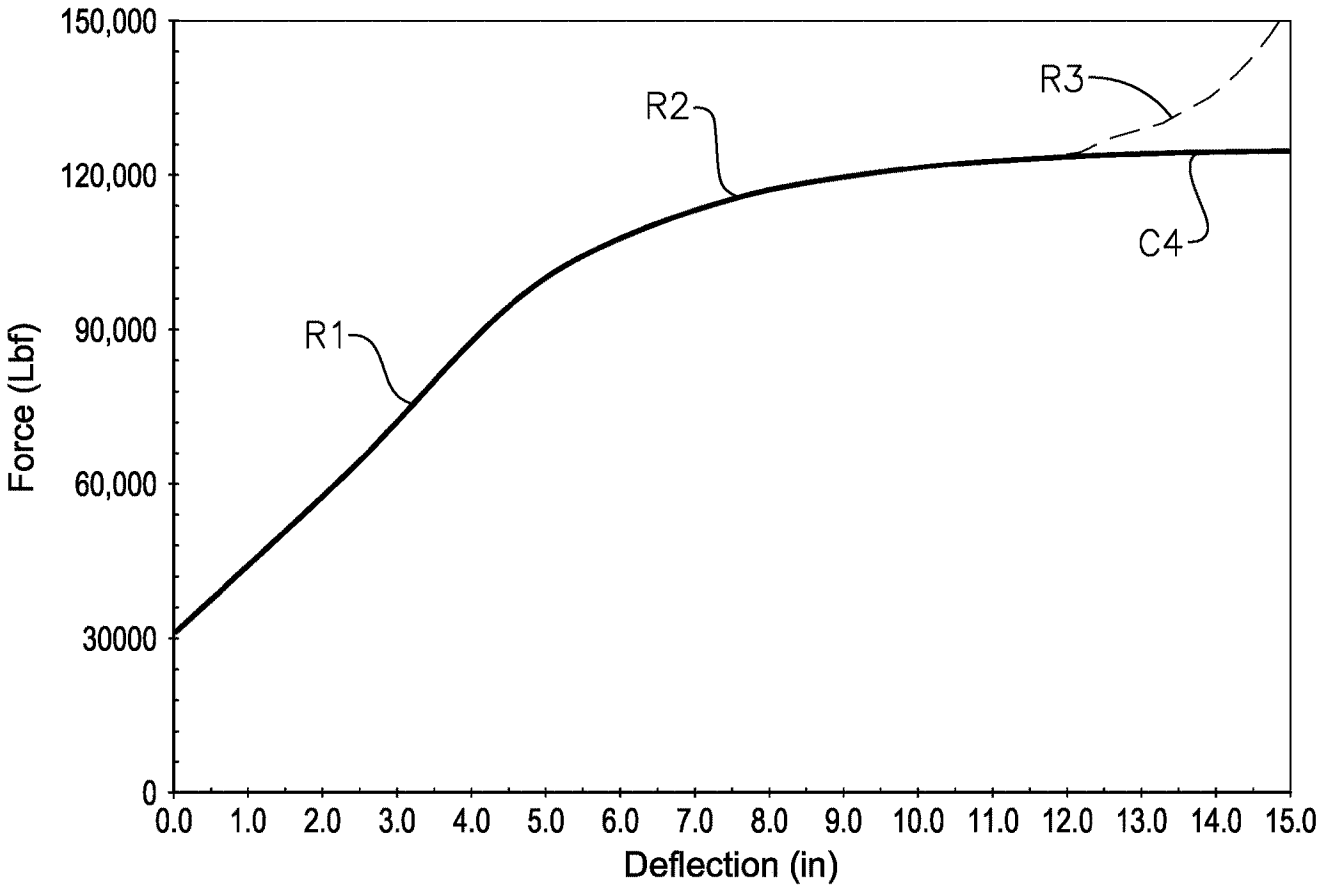
Figure 14:
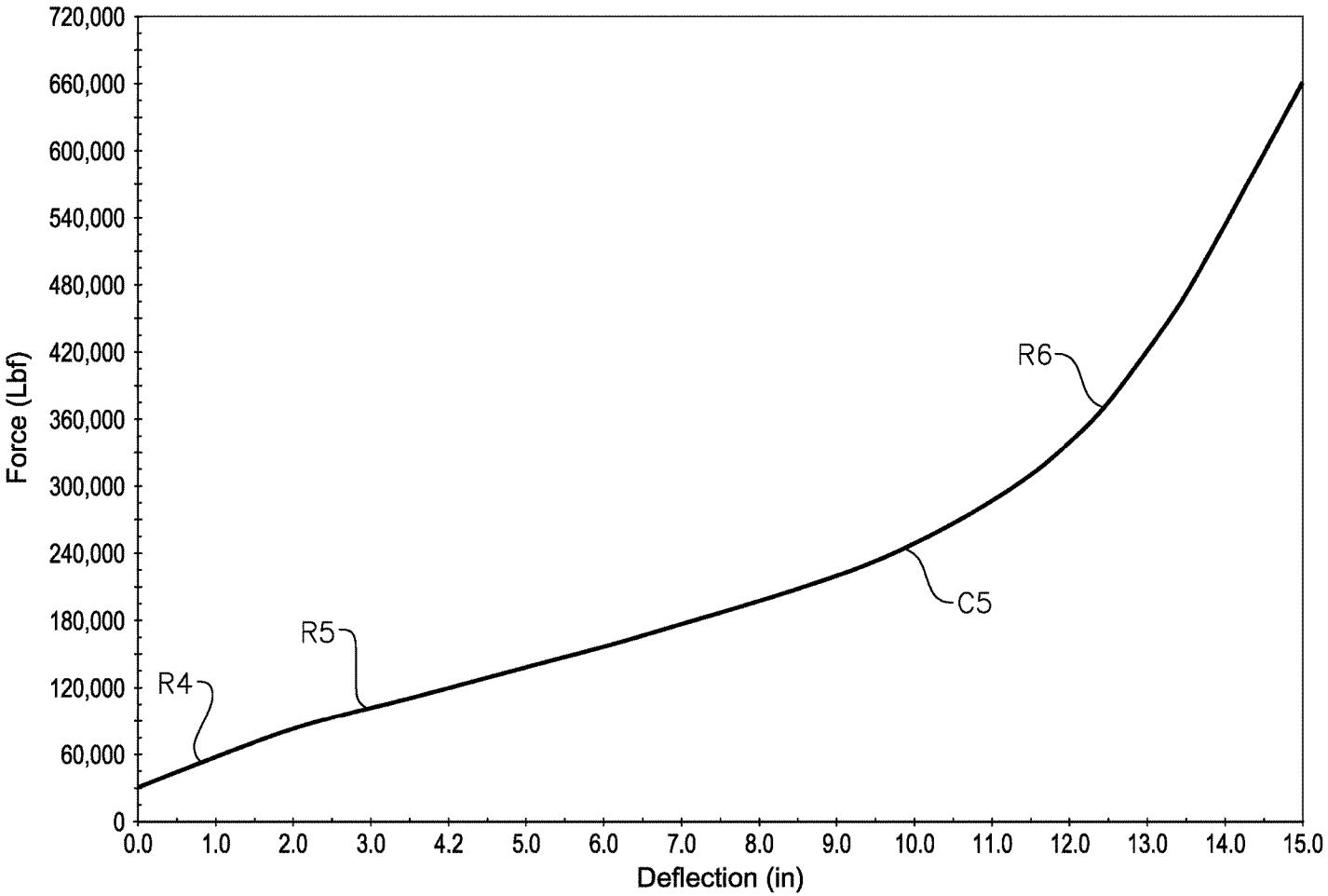
Figure 15:
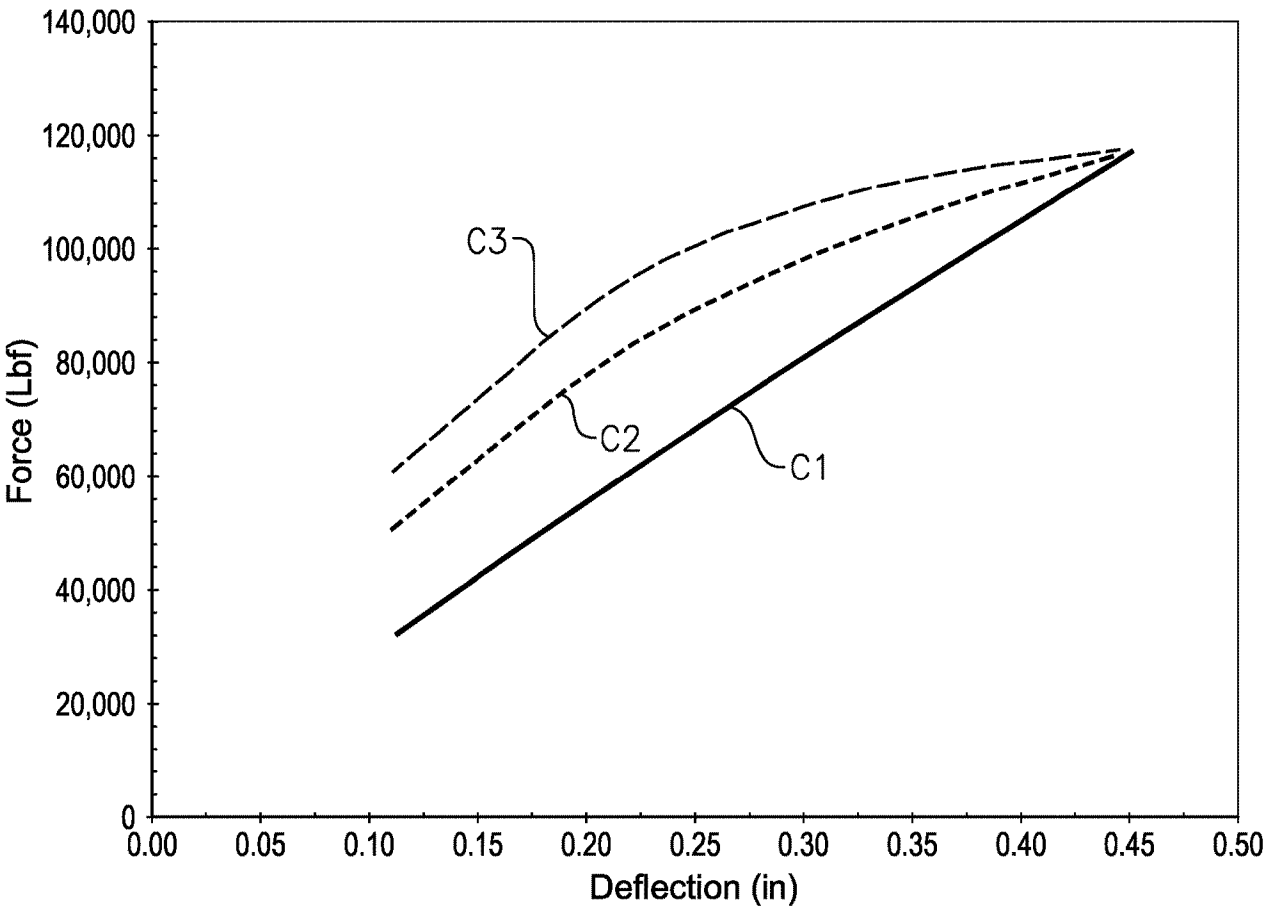
Figure 16:
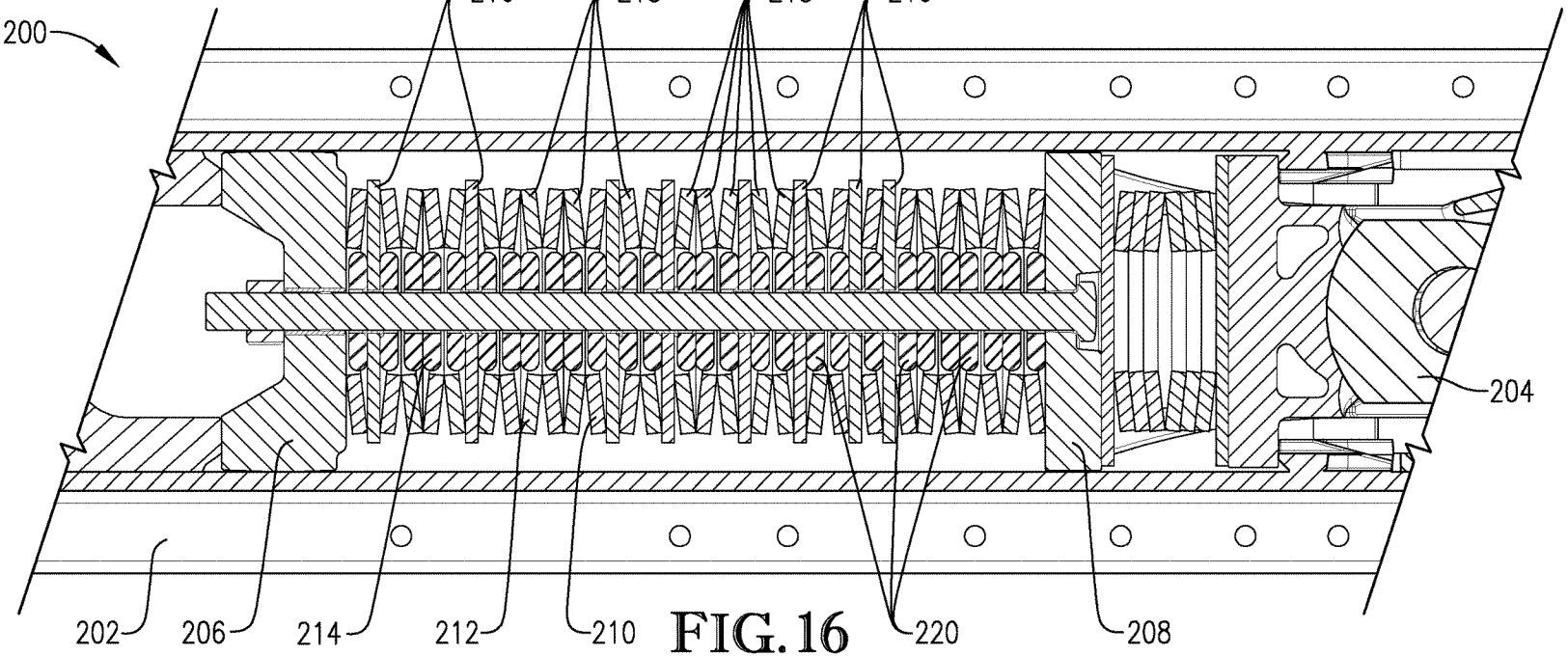

FIG. 7*a* is an enlarged fragmentary top view of the railcar end unit, center sill, and coupler in the neutral condition similar to FIG. 7, but enlarged to show disc springs of the buff spring pack and the draft spring pack and cushioning discs of the buff spring pack;

FIG. 7*b* is a greatly enlarged fragmentary top view of the railcar end unit in the neutral condition similar to FIGS. 7 and 7*a*, to further depict mounting rings associated with the cushioning discs and an outer sleeve attached to the cushioning discs;

FIG. 8 is a fragmentary side elevation of the railcar end unit, center sill, and coupler shown in FIGS. 2 and 7, with the end unit, center sill, and coupler being in the neutral condition and cross sectioned to show the buff spring pack and the draft end body;

FIG. 9 is a fragmentary top view of the railcar end unit, center sill, and coupler similar to FIG. 7, but showing a buff force applied to the coupler so that the end unit assumes a buff condition where the buff spring pack and draft spring pack are fully compressed;

FIG. 9*a* is an enlarged fragmentary top view of the railcar end unit, center sill, and coupler in the buff condition similar to FIG. 9, but enlarged to show disc springs of the buff spring pack and the draft spring pack and cushioning discs of the buff spring pack;

FIG. 9*b* is a greatly enlarged fragmentary top view of the railcar end unit in the buff condition similar to FIGS. 9 and 9*a*, to further depict mounting rings associated with the cushioning discs and the outer sleeve attached to the cushioning discs;

FIG. 10 is a fragmentary side elevation of the railcar end unit, center sill, and coupler similar to FIG. 8, but showing the buff force applied to the coupler, with the end unit in the buff condition (as depicted in FIG. 9);

FIG. 11 is a fragmentary top view of the railcar end unit, center sill, and coupler similar to FIG. 7, but showing a draft force applied to the coupler so that the end unit assumes a draft condition where the draft spring pack is fully compressed;

FIG. 12 is a fragmentary side elevation of the railcar end unit, center sill, and coupler similar to FIG. 8, but showing the draft force applied to the coupler, with the end unit in the draft condition (as depicted in FIG. 11);

FIG. 13 is a diagram showing a performance curve associated with the buff disc springs of the buff spring pack, where the curve is plotted to show how compressive force applied to the buff disc springs corresponds to deflection of the buff disc springs;

FIG. 14 is a diagram showing a performance curve associated with the disc springs of the buff spring pack and the draft spring pack, where the curve is plotted to show how compressive force applied to the disc springs of the buff and draft spring packs corresponds to deflection of the disc springs of the buff and draft spring packs;

FIG. 15 is a diagram showing multiple performance curves associated with individual disc springs of the spring packs, where the curve is plotted to show how compressive force applied to a single disc spring corresponds to deflection of the single disc spring; and FIG. 16 is a fragmentary top view of a railcar end unit, center sill, and coupler constructed in accordance with a second preferred embodiment of the present invention.

The drawing figures do not limit the present invention to the specific embodiments disclosed and described herein. The drawings are not necessarily to scale, emphasis instead being placed upon clearly illustrating the principles of the preferred embodiment.

DETAILED DESCRIPTION OF THE PREFERRED EMBODIMENTS

Figure 1:
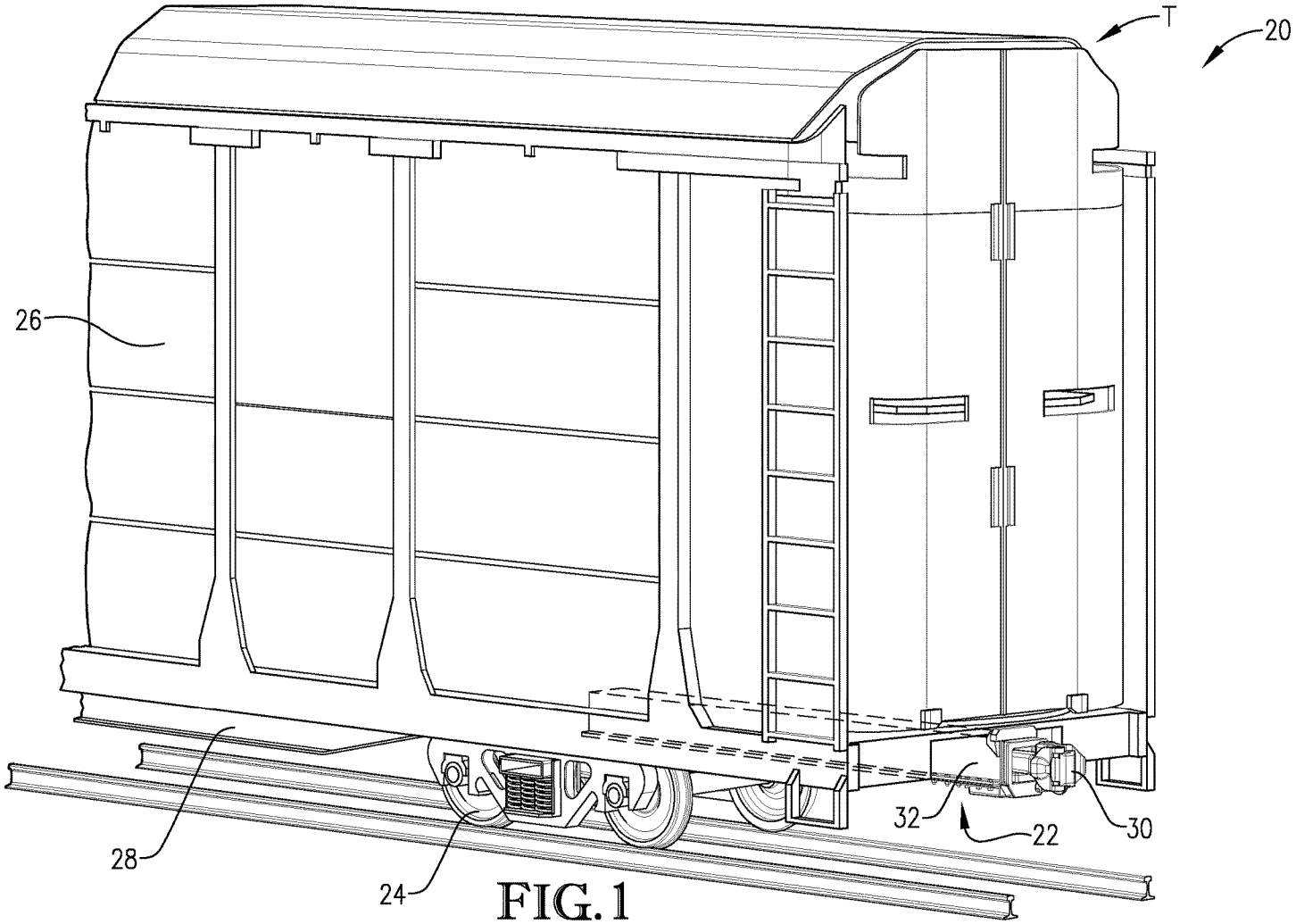
FIG. 1 is a perspective of a railcar that includes an under frame, a coupler, and a railcar end unit constructed in accordance with a first preferred embodiment of the present invention, with the railcar end unit being mounted in a center sill of the under frame.
Figure 3:
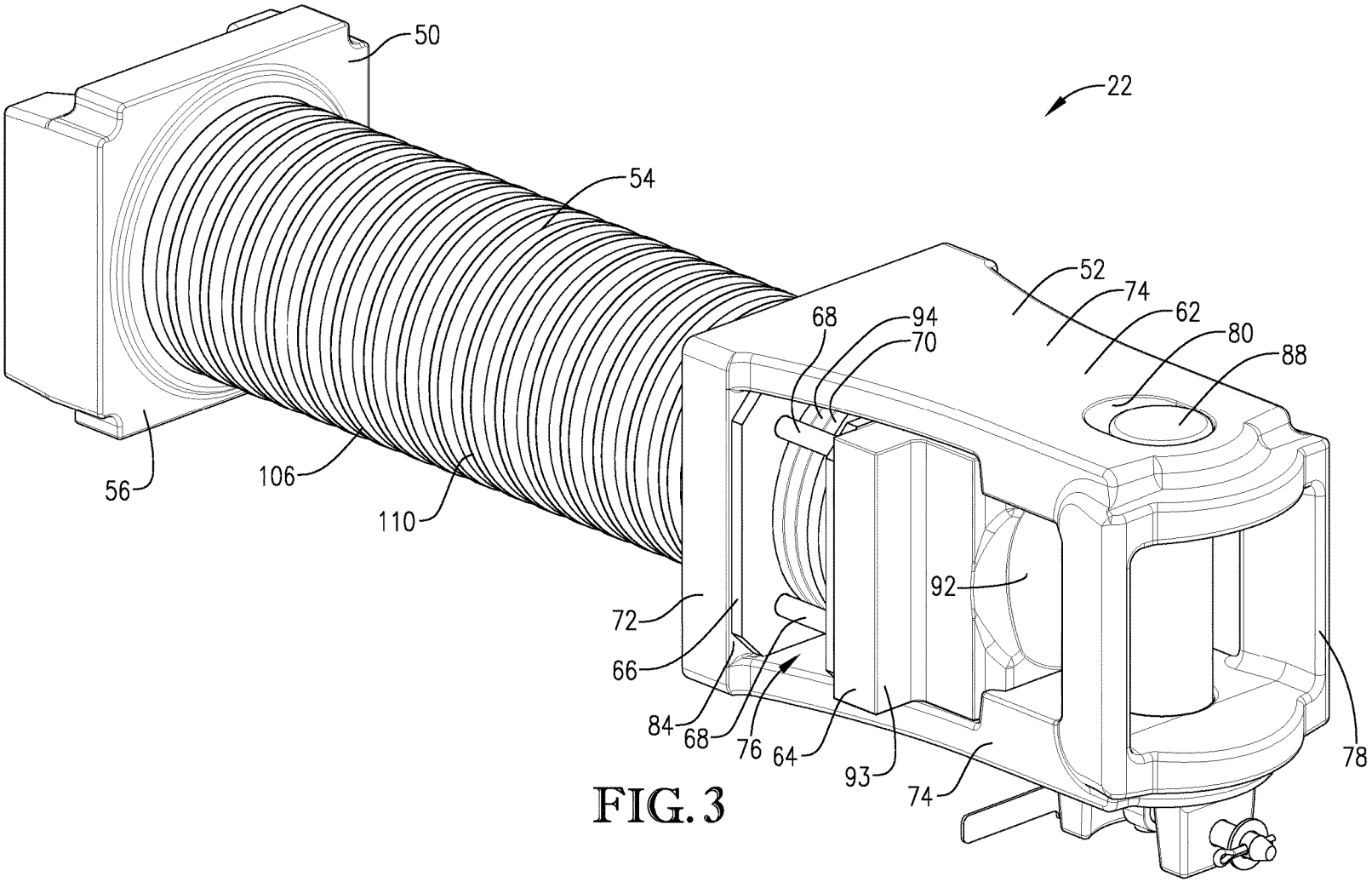
FIG. 3 is a perspective of the railcar end unit shown in FIG. 2, showing a buff end body, a draft end body, and a buff spring pack, and with the draft end body including a yoke, a draft follower body, and a draft spring pack.

Turning initially to FIGS. 1-3, a railcar 20 is configured to be used with a string of other cars (not shown) as part of a train T to haul materials (not shown). As is customary, the railcar 20 is connected behind an adjacent rail car (not shown) and may also be connected in front of another adjacent railcar. As will be described in greater detail, the railcar 20 has a railcar end unit 22 that provides a cushioned connection between itself and one of the adjacent railcars. It will be understood that the adjacent railcars also preferably have end units that are similarly constructed to end unit 22. However, for some aspects of the present invention, an adjacent railcar could have an end unit with one of various configurations of a cushioning unit or a draft gear. The railcar 20 preferably includes trucks 24 and a car body 26 mounted on the trucks 24.

The car body 26 is designed to support the weight of materials contained therein. At the same time, the car body 26 also transmits forces (such as tension and compression forces) from one end of the car body 26 to the other end. The illustrated car body 26 preferably includes an under frame 28, couplers 30 at opposite ends of the car body 26, and end units 22 at opposite ends of the car body 26. As will be described, each end unit 22 preferably interconnect and provide a cushioning mechanism between the under frame 28 and a corresponding coupler 30.

The under frame 28 is a generally rigid structure that extends along nearly the entire length of the railcar 20. In the usual manner, the under frame 28 includes a center sill 32 that defines a central longitudinal axis of the railcar 20 and serves as the structural spine of the under frame 28. The center sill 32 includes a generally rectangular or square tubular body 34, a buff sill stop 36 fixed to the body 34, and a draft sill stop 38 fixed to the body 34. The tubular body 34 includes a bottom iron 39 (see FIGS. 2 and 8) that is removable from the rest of the sill 32 to permit insertion and removal of the end unit 22 relative to the sill 32. The stops 36,38 cooperate with the body 34 to present an interior pocket 40 that extends axially along a sill axis S (see FIG. 2).

The illustrated pocket 40 generally conforms to the specifications of Pocket EOC-3 of Standard S-181, which is promulgated by the Association of American Railroads (AAR) and is hereby incorporated in its entirety by reference herein. Nevertheless, the principles of the present invention are equally applicable where the pocket 40 has an alternative configuration. For instance, the end unit 22 could be configured for installation in other pockets (e.g., where the pocket conforms to another pocket specification in Standard S-181 or to the pocket specification of a foreign organization).

Figure 4:
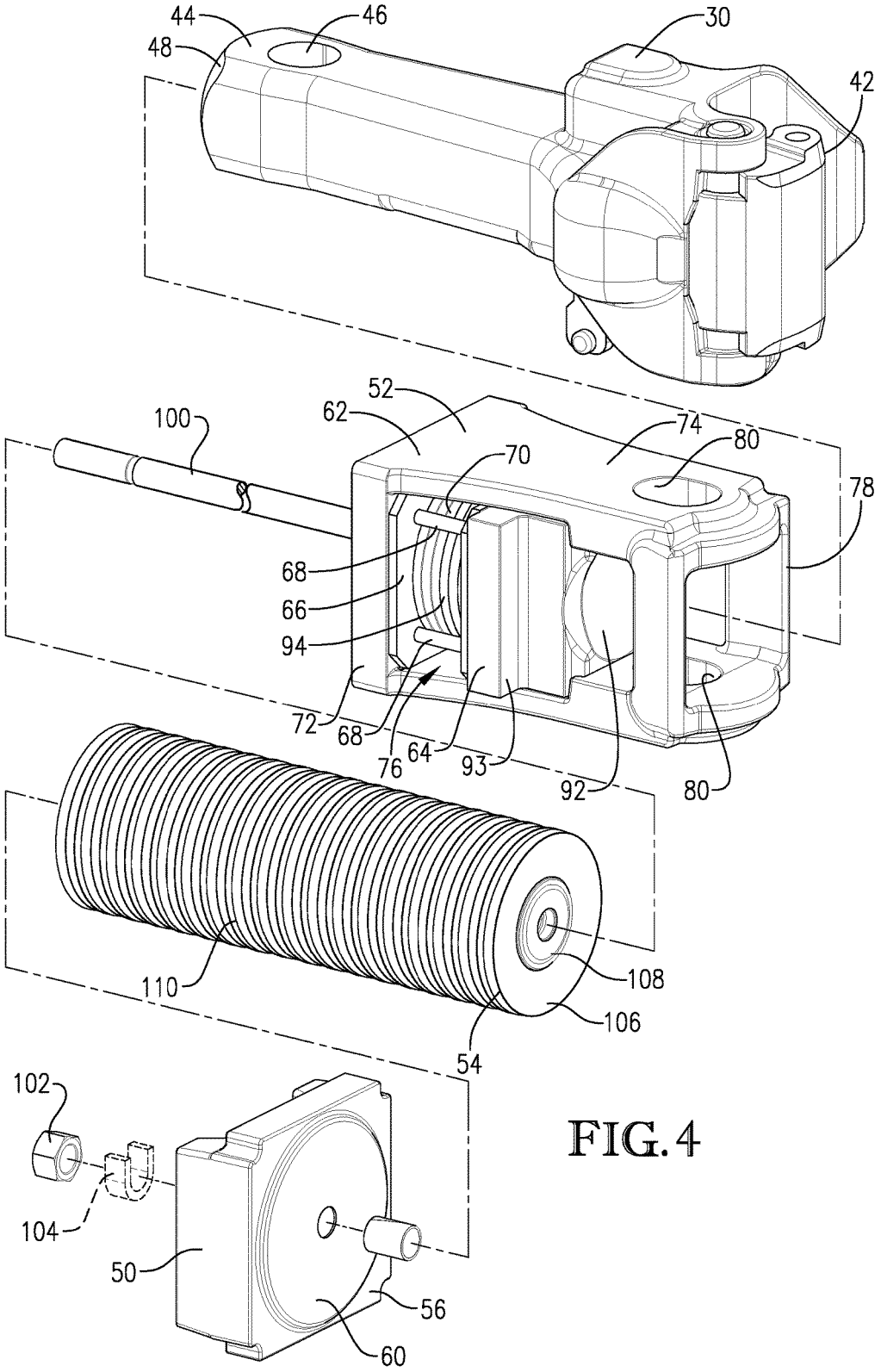
FIG. 4 is an exploded perspective of the railcar end unit and the coupler shown in FIG. 2, showing the buff spring pack being removed from a gag rod that connects the buff end body and the draft end body.

Turning to FIGS. 4, 7, and 7*a*, the coupler 30 is configured to be selectively engaged and disengaged with a similar coupler (not shown) of an adjacent railcar. The coupler 30 includes a connection end 42 and a shank end 44. The shank end 44 preferably presents an opening 46 and a rounded end surface 48.

The coupler 30 presents a longitudinal axis that is generally aligned with the sill axis S. As will be described, the coupler 30 is configured to engage the end unit 22 and shift the end unit 22 in a buff direction DB (see FIG. 9) during a buff compression event (i.e., a buff event). Similarly, the coupler 30 is configured to shift the end unit 22 in a draft direction DD (see FIG. 11) during a draft extension event (i.e., a draft event). A buff event is associated with a compression force BF (i.e., a so-called "buff" force) applied to the end unit 22 by the coupler 30 (see FIGS. 9 and 10). A draft event is associated with a tension force DF (i.e., a so-called "draft" force) applied to the end unit 22 by the coupler 30 (see FIGS. 11 and 12).

In the illustrated embodiment, the coupler 30 is shiftable from a neutral condition to a buff condition (see FIGS. 9 and 10) in response to a buff event. The coupler 30 is also shiftable from the neutral condition to a draft condition in response to a draft event (see FIGS. 11 and 12).

Turning to FIGS. 2-12, the railcar end unit 22 interconnects the center sill 32 and coupler 30 and operates as a cushioning device therebetween. The end unit 22 is operably mountable between the buff and draft sill stops 36,38 so that a unit axis U (see FIG. 2) is generally aligned with the sill axis S. The end unit 22 is shiftable by the coupler 30 from the neutral condition to the buff condition in response to a buff event. The end unit 22 is also shiftable by the coupler 30 from the neutral condition to the draft condition in response to a draft event.

In the illustrated embodiment, the end unit 22 preferably operates as an isolation mechanism that operates as a spring-and-damper system. As will be explained in greater detail, the depicted end unit 22 preferably includes a spring-and-damping mechanism that stores, dissipates, and releases energy. However, for some aspects of the present invention, the end unit 22 could be generally devoid of any damping mechanism.

As will be described, the railcar end unit 22 is preferably devoid of pressurized fluid but is configured to provide a buff stroke similar to conventional railcar cushioning devices. The depicted end unit 22 preferably includes a buff end body 50, a draft end body 52, and a buff spring pack 54 (see FIG. 3).

Turning to FIGS. 3-6, the buff end body 50 preferably comprises a unitary, rigid buff follower body 56 to engage the buff sill stop 36. The buff end body 50 presents a stop face 58 (see FIG. 6) and an oppositely facing a spring compression face 60 (see FIG. 4).

The draft end body 52 is operably attached to the coupler 30 and cooperates with the buff end body 50 to compress the buff spring pack 54. The draft end body 52 preferably includes a yoke 62, a draft follower body 64, spacer plates 66, retention bolts 68, and a draft spring pack 70.

Figure 5:
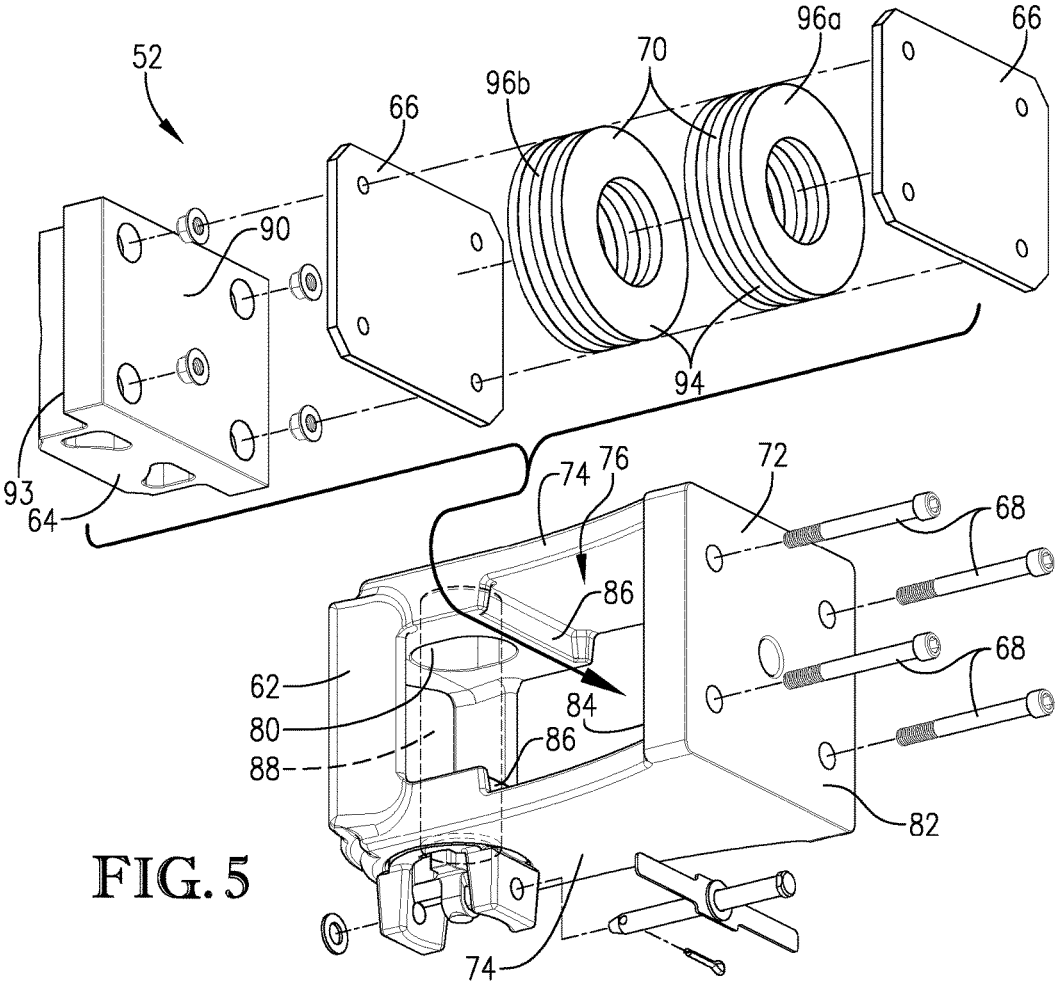
FIG. 5 is an exploded perspective of the draft end body shown in FIGS. 2-4, showing the draft spring pack and draft follower body removed from the yoke.
Figure 6:
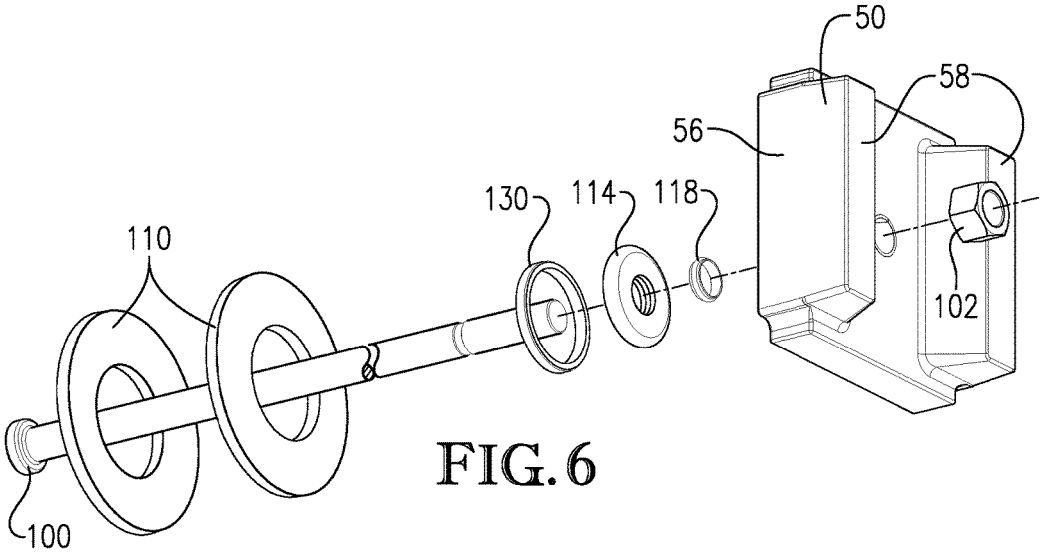
FIG. 6 is a fragmentary exploded perspective of the railcar end unit shown in FIGS. 2-4, showing disc springs and a cushioning disc of the buff spring pack received on the gag rod.

The illustrated yoke 62 comprises a monolithic frame that includes a base 72 and opposite sides 74 (see FIGS. 3 and 5). The yoke 62 presents a yoke chamber 76 that extends axially to communicate with a yoke end opening 78 (see FIG. 3). The yoke 62 also presents elongated slots 80 in the sides 74.

The base 72 presents opposite compression faces 82,84 (see FIGS. 5 and 7*b*). The sides 74 present shoulders 86 that face in opposition to the compression face 84 (see FIG. 5). The yoke chamber 76 is preferably sized and configured to shiftably receive the draft follower body 64 and draft spring pack 70.

The depicted yoke 62 is also configured to be engaged by the coupler 30. In particular, a coupler pin 88 extends through and operably attaches the coupler 30 and yoke 62 to one another. As will be discussed, the base 72 is preferably located between the buff spring pack 54 and the draft spring pack 70.

During a buff event, the depicted yoke 62 is shiftable toward the buff end body 50 from a neutral position (see FIGS. 7 and 8) to a buff position (see FIGS. 9 and 10). During a draft event, the yoke 62 is shiftable away from the buff end body 50 from the neutral position to a draft position (see FIGS. 11 and 12).

It will also be appreciated that the end unit 22 could include an alternatively configured yoke. For instance, the yoke could have an alternative construction to receive and carry the draft spring pack 70 and draft follower body 64 for shifting movement within the pocket 40. Yet further, for some aspects of the present invention, the end unit could be devoid of a yoke.

Still referring to FIGS. 3-6, the draft follower body 64 is shiftably received by the yoke 62 to selectively compress the draft spring pack 70. The draft follower body 64 comprises a unitary member that presents a draft compression face 90 (see FIG. 5) and a generally concave coupler face 92 (see FIG. 3). When installed in the yoke 62 with the draft spring pack 70, the draft follower body 64 cooperates with the yoke 62 to compress the draft spring pack 70.

In the pocket 40, the draft follower body 64 is configured to be engaged by the coupler 30, particularly during a buff event. The draft follower body 64 also presents shoulders 93 that are configured to engage the draft sill stop 38, particularly during a draft event.

Turning to FIGS. 3-6, 7*a*, and 9*a*, the draft spring pack 70 preferably includes a mechanical draft spring component 94 that is configured to absorb energy (e.g., where the draft spring pack 70 stores and dissipates energy) and to release energy associated with a draft event. In particular, the draft spring pack 70 is resiliently compressed along the unit axis U as the coupler 30 moves toward and into the draft condition to urge the coupler 30 toward the neutral condition. The draft spring component 94 preferably includes a plurality of axially arranged disc springs 96*a*,*b* (see FIG. 7*a*). It is also within the ambit of the present invention where the draft spring component 94 includes cushioning discs similar to cushioning discs in the buff spring pack 54 or other cushioning structure (e.g., to dissipate energy).

In the illustrated embodiment, each disc spring 96 preferably comprises a unitary frusto-conical spring washer that presents a small end 98*a* (in the radial direction) and a relatively large end 98*b* (see FIG. 7*a*). The disc spring 96 presents an outer diameter dimension D1 that ranges from about eight inches (8") to about twelve inches (12") (see FIG. 7*a*). The disc spring 96 also presents a thickness dimension D2 that ranges from about one tenth of an inch (0.1") to about one inch (1.0") (see FIG. 7*a*). Furthermore, the disc spring 96 presents a cone height dimension D3 that ranges from about one hundredth of an inch (0.01") to about five tenths of an inch (0.5") (see FIG. 7*a*). The dimension D3 is associated with the disc spring 96 in an unsprung or uncompressed condition (not shown). It will also be appreciated that the disc spring 96 could present one or more dimensions outside of the above-referenced dimensional ranges.

The principles of the present invention are also applicable where one or more of the disc springs 96 comprise an alternative type of non-flat, metallic disc spring. For instance, according to some aspects of the present invention, spring component 94 could additionally or alternatively include any one or more of the following: a contact disc spring, a curved disc spring, a composite disc spring, a serrated disc spring, a slotted disc spring, a wave spring, a custom disc spring, or a combination of multiple types of disc springs.

The disc spring 96 is preferably constructed in the form of an endless ring. However, it is within the ambit of the present invention where the disc spring 96 is not endless (e.g., such as a wave spring).

The depicted disc springs 96 preferably comprise an AISI 6150 steel material, but could include one or more alternative steel materials. It is also within the scope of the present invention where the disc springs 96 include an alternative metallic material or a nonmetallic material, such as a synthetic resin material.

Turning to FIG. 15, each disc spring 96 has a performance curve where the compression force generally increases with increasing compression (i.e., deflection) of the disc spring. As depicted in FIG. 15, the disc spring 96 can be associated with one of the illustrated performance curves C1,C2,C3, depending on the dimensions and/or materials of the disc spring 96.

In the plot shown in FIG. 15, the performance curve C1 illustrates a substantially linear spring behavior where the disc spring 96 has a substantially constant spring rate. As used herein, the term "spring rate" refers to the slope of the performance curve.

For performance curves C2,C3, the spring behavior comprises a nonlinear regressive behavior where the spring rate decreases with increasing deflection of the disc spring 96. It will be appreciated that one or more of the disc springs 96 could have a performance curve different than the illustrated curves C1,C2,C3.

The disc springs 96 are preferably configured to be fully compressed by a force that ranges from about thirty thousand pounds (30 klbs) to about one hundred forty thousand pounds (140 klbs). However, for some aspects of the present invention, the disc springs 96 could be sized and/or configured to be fully compressed by a force outside of this range.

The spring rate associated with each disc spring 96 preferably ranges from about ten thousand pounds per inch (10 klbs/in) to about five hundred thousand pounds per inch (500 klbs/in), although the spring rate could fall outside of this range. In some applications, it will be appreciated that the spring rate could approach half the initial spring rate where the disc spring has a highly regressive performance curve.

In the illustrated embodiment, each disc spring 96 has generally the same dimensions and performance curve as the other disc springs 96. However, the principles of the present invention are applicable where one or more of the disc springs 96 have dimensions and/or a performance curve that are different from the other disc springs 96.

Turning to FIG. 7*a*, the disc springs 96*a* are stacked alongside one another along the unit axis U. The set of disc springs 96*a* are arranged in a parallel configuration so that the disc springs 96*a* are nested with one another. Similarly, the set of disc springs 96*b* are also arranged in a parallel configuration and are nested with one another.

Preferably, adjacent disc springs 96*a,b* from each set are arranged in a series configuration where the adjacent disc springs 96*a,b* are not nested. Instead, the small ends 98*a* of the adjacent disc springs 96*a,b* are in end-to-end abutting engagement with each other. As a result, the depicted disc springs 96 are arranged in a combination stack that includes at least one parallel stack and at least one series stack.

Although the illustrated arrangement of disc springs 96 is preferred, the disc springs 96 could be alternatively positioned without departing from the scope of the present invention. For instance, all of the disc springs 96 could be arranged in series or in parallel with one another. Also, the disc springs 96 could be arranged in an alternative combination of series and parallel stacks. As mentioned previously, it is also consistent with the scope of the present invention where the draft spring component 94 includes cushioning discs similar to cushioning discs in the buff spring pack 54 or other cushioning structure (e.g., to dissipate energy).

Turning to FIGS. 7*a* and 9*a*, when the draft spring pack 70 is installed in the yoke 62 with the draft follower body 64, the draft follower body 64 cooperates with the yoke 62 to compress the draft spring pack 70.

Preferably, in the neutral condition (see FIG. 7*a*), the disc springs 96 of the draft spring pack 70 are resiliently compressed so that the draft spring component 94 is preloaded. In the illustrated embodiment, the draft spring pack 70 is preloaded to a draft preload force that ranges from about twenty thousand pounds (20 klbs) to about one hundred thousand pounds (100 klbs) and, more preferably, is about twenty-five thousand pounds (25 klbs).

When compressed and shifted out of the neutral condition, the depicted draft spring component 94 is preferably configured to store energy that can be released as the draft spring component 94 expands. As a result, the draft spring component 94 is dimensioned and configured to urge the draft follower body 64 and the yoke 62 apart from one another.

The draft spring component 94 presents a draft axial length L1 (see FIG. 7*a*) in the neutral condition that is reduced to a draft compressed length L2 (see FIG. 9*a*) when the draft spring component 94 is compressed into the buff condition (or in the draft condition). Thus, the draft follower body 64 and the base 72 move toward one another along an axial draft travel dimension L3 (see FIG. 9*a*) when shifting from the neutral condition to the buff condition (or to the draft condition). The draft travel dimension L3 preferably ranges from about zero inches (0") to about four inches (4").

In the illustrated embodiment, the draft spring pack 70 is retained within the yoke 62 by the sides 74 and by bolts 68. The bolts 68 restrict lateral movement (i.e., movement transverse to the unit axis U) of the draft spring pack 70 while permitting shifting of the draft follower body 64 and the draft spring pack 60 within the yoke 62.

Although the illustrated draft spring pack 70 only includes the disc springs 96, the draft spring pack 70 could include other components without departing from scope of the present invention. For instance, the draft spring pack 70 could include elastomeric cushioning discs and sleeves similar to those included in the buff spring pack 54.

The draft spring pack 70 preferably comprises a mechanical spring device. As used herein, the term "mechanical" refers to a spring device that does not operate as a spring and/or damping system by using compressed fluid and/or compressed gas. Rather, the inherent physical structure of the mechanical device provides the spring and/or damping response.

In any event, it is most preferable that the draft spring pack 70, including any cushioning component, be configured to provide suitable compression travel and cushioning while also being devoid of fluid (e.g., compressed hydraulic fluid or a compressed gas).

Turning to FIGS. 7-12, the coupler 30 is configured to be selectively engaged and disengaged with a similar coupler (not shown) of an adjacent railcar. The shank end 44 is engaged with the end unit 22 by securing the coupler pin 88 through the yoke 62 and the shank end 44.

When connected to the draft end body 52, the coupler 30 is configured to engage the coupler face 92 of the draft follower body 64, particularly during a buff event. The coupler 30 also engages and is configured to apply a force to the coupler pin 88, particularly during a draft event.

During a buff event, the coupler 30 engages the draft follower body 64 and is configured to shift the draft end body 52 in the buff direction DB (see FIGS. 9 and 10). As the coupler 30 shifts in the buff direction DB, the coupler 30 engages the coupler face 92 to apply force to the draft follower body 64. This force causes shifting movement of the follower body 64 relative to the center sill 32.

In response to a buff force BF (such as a relatively small buff force), it will be appreciated that little or no compression of the draft spring pack 70 may occur. As a result, the follower body 64 would generally shift with the yoke 62 in the buff direction DB. On the other hand, in response to a relatively large buff force BF, the buff spring pack 54 and the draft spring pack 70 can be compressed simultaneously. As a result, the follower body 64 would generally shift toward the base 72 of the yoke 62. Also in response to a relatively large buff force BF, the buff spring pack 54 may be completely compressed before the spring pack 70 becomes completely compressed.

During a draft event, the coupler 30 engages the coupler pin 88 and is configured to shift the draft end body 52 in the draft direction DD (see FIGS. 11 and 12). The coupler 30 engages the coupler pin 88 to apply the draft force DF. The draft follower body 64 is also configured to engage the draft sill stop 38, particularly during a draft event.

As the coupler 30 shifts in the draft direction DD away from the draft follower body 64, the coupler 30 permits the draft follower body 64 to move toward and into engagement with the draft sill stop 38. This occurs because the draft spring component 94 urges the draft follower body 64 and the yoke 62 apart from one another.

Turning to FIGS. 4-7, the buff and draft end bodies 50,52 are preferably spaced apart from one another along the unit axis U and are connected to one another by a gag rod 100. The gag rod 100 extends through the base 72 and the buff end body 50. The gag rod 100 is secured by a threaded nut 102 to the buff end body 50. Prior to installation of the end unit 22 in the pocket 40, a gag sleeve 104 is mounted on the gag rod 100 between the nut 102 and the buff end body 50 (see FIG. 4). The gag sleeve 104 is then removed from the end unit 22 after installation.

The depicted gag rod 100 is preferably made from steel, but could include other materials without departing from the scope of the present invention. The gag rod 100 preferably supports the buff spring pack 54 between the end bodies 50,52.

The buff and draft end bodies 50,52 are configured to be shiftably mounted relative to the center sill 32 to engage the buff and draft sill stops 36,38, respectively. The end bodies 50,52 are axially shiftable relative one another along the gag rod 100 (e.g., during a buff event).

Turning to FIGS. 3-12, the buff spring pack 54 is configured to absorb energy (e.g., where the buff spring pack 54 stores and dissipates) and to release energy associated with a buff event. As will be discussed, the buff spring pack 54 is operably mounted between the end bodies 50,52 and is compressible along the unit axis U from the neutral condition to the compressed condition during a buff event.

The depicted buff spring pack 54 preferably includes a buff spring component 106 and a buff cushioning component 108. The components 106,108 are operably arranged between the end bodies 50,52 so as to be resiliently compressed along the unit axis U when the buff spring pack 54 is in the compressed condition. As will be explained, the buff spring pack 54 is axially compressed along the unit axis U when the coupler 30 is in the buff condition. The buff spring pack 54 is preferably dimensioned and configured to urge the coupler 30 toward the neutral condition. However, according to some aspects of the present invention, the buff spring pack could be alternatively configured and arranged to principally dissipate (or "burn off") energy as the end bodies 50 and 52 move toward one another.

In the illustrated embodiment, the buff spring pack 54 is mounted on the gag rod 100 and is thereby operably coupled to the end bodies 50,52. Preferably, the spring component 106 and the cushioning component 108 are coaxially received on the gag rod 100.

The buff spring component 106 preferably includes a plurality of axially arranged disc springs 110 (see FIG. 7*b*). In the illustrated embodiment, each disc spring 110 preferably comprises a unitary frusto-conical spring washer that presents a small end 112*a* (measured in the radial direction) and a relatively large end 112*b* (see FIG. 7*a*). The disc spring 110 presents an outer diameter dimension D4 that ranges from about eight inches (8") to about twelve inches (12") (see FIG. 7*b*).

The disc spring 110 also presents a thickness dimension D5 that ranges from about one tenth of an inch (0.1") to about one inch (1.0") (see FIG. 7*b*). The disc spring 110 also presents a cone height dimension D6 that ranges from about one hundredth of an inch (0.01") to about five tenths of an inch (0.5") (see FIG. 7*b*). The dimension D6 is associated with the disc spring 110 in an unsprung condition (not shown). It will also be appreciated that the disc spring 110 could present one or more dimensions outside of the above-referenced dimensional ranges.

The principles of the present invention are also applicable where one or more of the disc springs 110 comprise an alternative type of non-flat, metallic disc spring. For instance, according to some aspects of the present invention, spring component 106 could additionally or alternatively include any one or more of the following: a contact disc spring, a curved disc spring, a composite disc spring, a serrated disc spring, a slotted disc spring, a wave spring, a custom disc spring, or a combination of multiple types of disc springs.

The disc spring 110 is preferably constructed in the form of an endless ring. However, it is within the ambit of the present invention where the disc spring 110 is not endless (e.g., such as a wave spring).

The depicted disc springs 110 preferably comprise an AISI 6150 steel material, but could include one or more alternative steel materials. It is also within the scope of the present invention where the disc springs include an alternative metallic material or a nonmetallic material, such as a synthetic resin material.

As with disc springs 96, each disc spring 110 has a performance curve where the applied force generally increases with increasing compression (i.e., deflection) of the disc spring 110. As depicted in FIG. 15, the disc springs 110 can be associated with one of the illustrated performance curves C1,C2,C3, depending on the dimensions and/or materials of the disc spring 110.

Again, in the plot shown in FIG. 15, the performance curve C1 illustrates a substantially linear spring behavior with a substantially constant spring rate, while the performance curves C2,C3 have a nonlinear regressive behavior. It will be understood that one or more of the disc springs 110 could have a performance curve different than the illustrated curves C1,C2,C3.

The disc springs 110 are preferably configured to be fully compressed by a force that ranges from about thirty thousand pounds (30 klbs) to about one hundred forty thousand pounds (140 klbs). However, for some aspects of the present invention, the disc springs 110 could be sized and/or configured to fully compressed by a force outside of this range.

The spring rate associated with each disc spring 110 preferably ranges from about ten thousand pounds per inch (10 klbs/in) to about five hundred thousand pounds per inch (500 klbs/in), although the spring rate could fall outside of this range. In some applications, it will be appreciated that the spring rate could approach half the initial spring rate where the disc spring has a highly regressive performance curve.

In the illustrated embodiment, each disc spring 110 has generally the same dimensions and performance curve as the other disc springs 110. However, the principles of the present invention are applicable where one or more of the disc springs 110 have dimensions and/or a performance curve that are different from the other disc springs 110.

Turning again to FIGS. 3-12, the disc springs 110 are stacked alongside one another along the unit axis U. In particular, the illustrated disc springs 110 are arranged in a series configuration so that the disc springs 110 are not nested with one another. Instead, the small ends 112*a* of certain pairs of adjacent disc springs 110 are in end-to-end abutting engagement with each other (see FIG. 7*b*). Similarly, the large ends 112*b* of certain pairs of adjacent disc springs 110 are in end-to-end abutting engagement with each other. That is, each disc spring 110 has its short end 112*a* in engagement with the short end of one adjacent disc spring and its long end 112*b* in engagement with the long end of the other adjacent disc spring. This arrangement is accomplished by alternating the orientation of adjacent disc springs 110, such that every other spring is oriented in the same direction.

Although the illustrated arrangement of disc springs 110 is preferred, the disc springs 110 could be alternatively positioned without departing from the scope of the present invention. For instance, as will be shown in a subsequent embodiment, the disc springs 110 could be arranged in a combination of series and parallel stacks.

It will be appreciated that various combinations of series and/or parallel stacks of disc springs (e.g., by altering the orientation and/or number of disc springs) can be used to produce a desired performance curve for the buff spring pack 54.

The buff spring component 106 is preferably received on the gag rod 100 between the end bodies 50,52. The spring component 106 and the cushioning component 108 are preferably coaxially received on the gag rod 100, as will be discussed. When the buff spring pack 54 is installed, the end bodies 50,52 cooperate with each other to compress the buff spring pack 54.

Preferably, in the neutral condition, the disc springs 110 of the buff spring pack 54 are resiliently compressed so that the spring component 106 is preloaded. In the illustrated embodiment, the buff spring pack 54 is preloaded to a buff preload force that ranges from about thirty thousand pounds (30 klbs) to about one hundred thousand pounds (100 klbs) and, more preferably, is about thirty-five thousand pounds (35 klbs).

When compressed out of the neutral condition, the depicted buff spring component 106 is preferably configured to store energy that can be released as the buff spring component 106 expands. As a result, the buff spring component 106 is preferably dimensioned and configured to urge the end bodies 50,52 apart from one another (e.g., from the buff condition toward the neutral condition).

The buff spring pack 54 presents a buff axial length L4 (see FIG. 7) in the neutral condition that is reduced to a buff compressed length L5 (see FIG. 9) when the buff spring pack 54 is compressed into the buff condition. Thus, the end bodies 50,52 move toward one another along an axial buff travel dimension L6 (see FIG. 9) when shifting from the neutral condition to the buff condition.

The buff travel dimension L6 preferably ranges from about ten inches (10") to about eighteen inches (18"). However, for some aspects of the present invention, the buff travel dimension L6 could fall outside of this range (e.g., when using an end unit configured to be installed in place of a conventional draft gear).

Turning to FIG. 13, the depicted buff spring component 106 has a performance curve C4 where the applied force generally increases with increasing compression travel (i.e., deflection) of the buff spring component 106.

The spring behavior preferably includes a nonlinear regressive behavior where the spring rate decreases with increasing deflection of the spring component 106 along at least part of the buff stroke. In the illustrated embodiment, the curve C4 includes a generally linear response region R1, in which the spring component 106 has a relatively high spring rate associated with relatively lower forces and deflections, and a generally regressive response region R2, in which the spring component 106 has a relatively low spring rate associated with relatively higher forces and deflections.

Also shown in the plot depicted in FIG. 13, the curve could include a progressive response region R3 at the end of the curve C4 and having a relatively high spring rate. Furthermore, it will be appreciated that the performance curve C4 of the buff spring component 106 could have one or more alternatively shaped regions.

In combination, the buff spring component 106 and draft spring component 94 cooperatively produce a buff performance curve C5 where the applied force generally increases with increasing combined compression travel (i.e., deflection) of the spring components 94,106 (see FIG. 14).

The spring behavior preferably includes a nonlinear regressive behavior where the spring rate decreases with increasing deflection of the spring component 106 along at least part of the buff stroke. In the illustrated embodiment, the curve C5 includes a generally linear response region R4, in which the combined components 94,106 have a relatively high spring rate associated with relatively lower forces and deflections, and a generally regressive response region R5, in which the combined components 94,106 have a relatively low spring rate. The curve C5 also includes a generally progressive response region R6, associated with relatively higher forces and deflections, and in which the combined components 94,106 have a relatively higher spring rate than the regions R4,R5.

Turning to FIGS. 7*a*, 7*b*, 9*a*, and 9*b*, the illustrated buff cushioning component 108 is operable to provide the buff spring pack 54 with additional cushioning, wherein the cushioning component 108 preferably cooperates with the buff spring component 106 to absorb a buff force while also providing dissipation of energy associated with a buff event.

The buff cushioning component 108 preferably includes a plurality of axially arranged cushioning discs 114, an outer sleeve 116, and inner mounting rings 118. The discs 114 are primarily dimensioned and configured to dissipate energy, although the discs 114 are operable to also store energy.

The cushioning discs 114 are arranged in series with one another along the unit axis U. In the neutral condition, the cushioning discs 114 are preferably uncompressed, with at least some pairs of adjacent discs 114 being spaced apart from one another (see FIG. 7*b*). As a result, the illustrated components 106,108 are partly coextensive with one another.

However, it is within the ambit of the present invention where each adjacent pair of discs 114 are in abutting engagement with each other in the neutral condition (in which case the buff spring component 106 and the buff cushioning component 108 would be fully coextensive). Furthermore, the discs 114 could be compressed in the neutral condition.

Each cushioning disc 114 preferably comprises a unitary, endless ring of elastomeric material and presents radially inner and outer rim surfaces 120,122 (see FIG. 7*b*).

The material of the illustrated disc 114 preferably comprises a thermoplastic elastomer identified under the brand name Hytrel®, which is manufactured by DuPont™. This material has been found to be particularly effective for use as a cushioning disc because the material resists compression set and minimizes hysteresis.

However, it is within the ambit of the present invention where the cushioning disc material includes a thermoplastic or a thermoset material. Furthermore, the cushioning disc 114 could include an alternative elastomer, such as a synthetic rubber or a natural rubber. It will also be appreciated that the cushioning disc 114 can be formed using various manufacturing processes (e.g., where the disc is formed by a molding process and/or a machining process).

The cushioning disc 114 is preferably constructed in the form of an endless ring. However, it is within the ambit of the present invention where the cushioning disc 114 does not have an endless shape. For instance, the disc could include a series of disc segments arranged circumferentially.

Each cushioning disc 114 is preferably supported on one of the mounting rings 118. Each mounting ring 118 preferably comprises a unitary, endless ring that includes a synthetic resin material. The mounting ring 118 presents an outer surface 124 with a circumferential rib 126 (see FIG. 7*b*). The rib 126 is configured to be received in a complemental groove 128 defined by the inner rim surface 120 of the disc 114 (see FIG. 7*b*).

The material of the mounting ring 118 preferably comprises a material that is relatively harder than the material of the cushioning disc 114.

Although the illustrated embodiment preferably includes the depicted cushioning discs 114, the buff spring pack 54 could include an alternative cushioning element. For instance, the buff cushioning component 108 could have an alternative number of cushioning discs and/or cushioning discs that are alternatively sized.

In some alternative cases, the buff cushioning component 108 could comprise a unitary cushioning structure (such as a unitary spring) without departing from the scope of the present invention. For instance, the unitary spring could comprise a continuous elastomeric sleeve or a metallic spring (such as a coil spring).

It is also within the scope of the present invention where the buff cushioning component 108 includes alternative elements to provide alternative spring and/or damping performance. For instance, the cushioning component could include one or more metallic springs so that the component provides little or no damping. The cushioning component could also have one or more alternative damping components, such as friction washers, to dissipate energy associated with a buff event. For some aspects of the present invention, the buff spring pack 54 could be devoid of a buff cushioning component.

The buff spring pack 54 preferably comprises a mechanical spring device. Again, the term "mechanical" refers to a spring device that does not operate as a spring and/or damping system by using compressed hydraulic fluid and/or compressed pneumatic fluid (i.e., compressed gas). Rather, the inherent physical structure of the mechanical device provides the spring and/or damping response.

In any event, it is most preferable that the buff spring pack 54, including any buff cushioning component, be configured to provide suitable compression travel and cushioning while also being devoid of fluid (e.g., compressed hydraulic fluid or a compressed gas).

The cushioning discs 114 are preferably received on the gag rod 100 and located between the end bodies 50,52. More preferably, the spring component 106 and the cushioning component 108 are preferably coaxially arranged, with the cushioning component 108 being received radially inside the spring component 106.

However, it is within the ambit of the present invention where the components 106,108 are alternatively located relative to each other. For example, the components 106,108 could be configured so that the spring component 106 is received radially inside the cushioning component 108. For some aspects of the present invention, the components 106,108 could also be positioned in a side-by-side relationship. Yet further, the components 106,108 are operably coupled between the bodies 50,52, but certain aspects of the present invention contemplate the components being radially offset so that the components are not physically located between the bodies.

Again, when installed, the cushioning discs 114 are preferably uncompressed in the neutral condition.

In the depicted embodiment, the outer sleeve 116 is cooperatively formed by a series of outer rings 130 that are mounted on corresponding cushioning discs 114 (see FIG. 9*b*). Each outer ring 130 preferably includes a unitary, endless ring formed of a synthetic resin material, although the outer ring could include a metallic material (such as steel). The outer ring 130 presents an inner circumferential groove 132 (see FIG. 9*b*) that is configured to receive the outer rim surface 122 of the cushioning disc 114 (see FIG. 9*b*). The material of the outer ring 130 preferably comprises a material that is relatively harder than the material of the cushioning disc 114.

When installed on the gag rod 100 together, the components 106,108 cooperatively define an axially extending annular interface 134 along which the components 106,108 are adjacent to one another (see FIG. 9*b*). The sleeve 116 is preferably located along the interface 134 so as to separate the cushioning discs 114 from the disc springs 110. Therefore, in the illustrated embodiment, the sleeve 116 is positioned radially outside the cushioning discs 114 and radially inside the disc springs 110, although alternative configurations are permitted, as noted.

Although the buff spring pack 54 preferably includes the depicted components 106,108, the buff spring pack 54 could include alternative components to provide suitable spring and damping response. For instance, as will be shown in a subsequent embodiment, the buff spring pack could have spacer plates located between pairs of disc springs.

As mentioned previously, the spring and cushioning components 106,108 are partly axially coextensive in the neutral condition. In the neutral condition, the disc springs 110 are preferably partially compressed while the cushioning discs 114 are uncompressed. In the compressed condition, the spring and cushioning components 106,108 are both compressed. Consequently, the components 106,108 are simultaneously compressed along part of the stroke of the buff spring pack 54.

However, the components 106,108 could be simultaneously compressed along the entire stroke of the buff spring pack 54. For instance, each adjacent pair of cushioning discs 114 and each adjacent pair of disc springs 110 could be in abutting engagement with each other in the neutral condition.

The illustrated buff and draft spring packs 54,70 can be configured to absorb a buff compression force ranging up to one million two hundred fifty thousand pounds (1250 klbs), although the buff and draft spring packs 54,70 could be configured to absorb higher forces.

Although not shown, the combination of the buff spring component 106 and buff cushioning component 108 produces a buff performance curve (similar to curve shown in FIG. 13) where the compression force generally increases with increasing compression travel (i.e., deflection) of the spring and cushioning components 106,108. The curve preferably includes a regressive response region (associated with relatively lower forces and deflections) and a progressive response region (associated with relatively higher forces and deflections).

In use, the railcar end unit 22 is installed in the pocket 40 so that the buff spring pack 54 and the draft spring pack 70 are both preloaded. During a buff event, the coupler 30 is operable to shift the end unit 22 in the buff direction DB, with the end unit 22 shifting from the neutral condition toward the buff condition. During a buff event, the coupler 30 engages the draft follower body 64 and is configured to shift the draft end body 52 in the buff direction DB. As the coupler 30 shifts in the buff direction DB, the coupler 30 engages the coupler face 92 to apply a buff force BF to the draft follower body 64. This force causes shifting movement of the follower body 64 relative to the center sill 32.

In some instances, it will be appreciated that the buff spring pack 54 may be compressed in response to the buff force, but with little or no compression of the draft spring pack 70. In other instances, the buff spring pack 54 and the draft spring pack 70 can be compressed simultaneously.

During a draft event, the coupler 30 engages the coupler pin 88 and is configured to shift the draft end body 52 in the draft direction DD. The coupler 30 engages the coupler pin 88 to apply the draft force DF. The draft follower body 64 is also configured to engage the draft sill stop 38, particularly in the neutral condition and during a draft event.

As the coupler 30 shifts in the draft direction DD and away from the draft follower body 64, the draft follower body 64 engages the draft sill stop 38 and the yoke moves in the draft direction to compress the draft spring pack 70. At the same time, the buff spring pack 54 and the buff end body 50 move away from the buff sill stop. Thus, the buff spring pack 54 remains in a preloaded condition of compression that corresponds to compression of the buff spring pack 54 in the neutral condition.

Turning to FIG. 16, an alternative railcar end unit 200 is constructed in accordance with a second embodiment of the present invention. For the sake of brevity, the remaining description will focus primarily on the differences of this alternative embodiment relative to the preferred embodiment described above.

The alternative end unit 200 is installed in a center sill 202 and is attached to a coupler 204. The end unit 200 includes an buff end body 206, an alternative draft end body 208, and an alternative buff spring pack 210.

The buff spring pack 210 preferably includes an alternative buff spring component 212, an alternative buff cushioning component 214, and spacer washers 216. As with the previous embodiment, the spring component 212 includes a stacked arrangement of disc springs 218. The illustrated disc springs 218 are alternatively arranged into a combination of series and parallel stacks. The cushioning component 214 includes a stacked series of cushioning discs 220 and is devoid of an outer sleeve and mounting rings.

Some pairs of adjacent disc springs 218 have a spacer washer 216 located therebetween. The illustrated spacer washers 216 are preferably used to facilitate a desired number and/or configuration of disc springs 218 within the buff spring pack 210 to customize the response of the end unit 200. One or more spacer washers 216 can also be inserted to permit the use of differently sized disc springs 218 and/or differently sized cushioning discs 220 within the end unit 200. The spacer washers 216 preferably comprise a steel material, but could include another metallic or nonmetallic material. It is also within the scope of the present invention where the spacer washers 216 include a composite or plastic bushing on the inside diameter to restrict wear between the washers 216 and the gag rod.

Although the above description presents features of preferred embodiments of the present invention, other preferred embodiments may also be created in keeping with the principles of the invention. Such other preferred embodiments may, for instance, be provided with features drawn from one or more of the embodiments described above. Yet further, such other preferred embodiments may include features from multiple embodiments described above, particularly where such features are compatible for use together despite having been presented independently as part of separate embodiments in the above description.

The preferred forms of the invention described above are to be used as illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventors hereby state their intent to rely on the Doctrine of Equivalents to determine and assess the reasonably fair scope of the present invention as pertains to any apparatus not materially departing from but outside the literal scope of the invention as set forth in the following claims.

What is claimed is:

1. A railcar end unit for interconnecting a center sill and a railcar coupler, wherein the end unit is operably mountable between buff and draft sill stops, said railcar end unit comprising:

buff and draft end bodies spaced apart from one another along a unit axis, said buff and draft end bodies configured to be shiftably mounted relative to the center sill to engage the buff and draft sill stops, respectively, with the end bodies being axially shiftable toward one another during a compression event; and a buff spring pack operably mounted between the end bodies and compressible along the unit axis from a neutral condition to a compressed condition during the compression event, said buff spring pack including a spring component and a cushioning component, each of which is operably arranged between the end bodies so as to be resiliently compressed when the buff spring pack is in the compressed condition, said spring component including a plurality of axially arranged disc springs, said spring and cushioning components being at least in part axially coextensive so as to be simultaneously compressible during at least part of the compression event, said cushioning component including a plurality of axially arranged cushioning discs primarily dimensioned and configured to dissipate energy, said components being generally coaxially arranged, with one of the components being received in the other one of the components, said components cooperatively defining an axially extending interface along which the components are adjacent one another, said cushioning component including a sleeve that is relatively harder than the cushioning discs, said sleeve being located along the interface so as to separate the cushioning discs from the disc springs.

2. The railcar end unit as claimed in claim 1, said cushioning discs including an elastomeric material.

3. The railcar end unit as claimed in claim 1, said spring component being dimensioned and configured to urge the end bodies apart from the compressed condition toward the neutral condition.

4. The railcar end unit as claimed in claim 3, said disc springs being resiliently compressed in the neutral condition so that the spring component is preloaded.

5. A railcar end unit for interconnecting a center sill and a railcar coupler, wherein the end unit is operably mountable between buff and draft sill stops, said railcar end unit comprising:

buff and draft end bodies spaced apart from one another along a unit axis, said buff and draft end bodies configured to be shiftably mounted relative to the center sill to engage the buff and draft sill stops, respectively, with the end bodies being axially shiftable toward one another during a compression event; and a buff spring pack operably mounted between the end bodies and compressible along the unit axis from a neutral condition to a compressed condition during the compression event, said buff spring pack including a spring component and a cushioning component, each of which is operably arranged between the end bodies so as to be resiliently compressed when the buff spring pack is in the compressed condition, said spring component including a plurality of axially arranged disc springs, said spring and cushioning components being at least in part axially coextensive so as to be simultaneously compressible during at least part of the compression event, said spring component being dimensioned and configured to urge the end bodies apart from the compressed condition toward the neutral condition, said disc springs being resiliently compressed in the neutral condition so that the spring component is preloaded, said cushioning component including a series of axially arranged cushioning discs primarily dimensioned and configured to dissipate energy, with the cushioning discs being uncompressed in the neutral condition.

6. The railcar end unit as claimed in claim 5, said components being generally coaxially arranged, with one of the components being received in the other one of the components.

7. The railcar end unit as claimed in claim 5, each of said disc springs comprising a non-flat, metallic disc spring.

8. The railcar end unit as claimed in claim 7, each of said disc springs comprising a frusto-conical spring washer.

9. The railcar end unit as claimed in claim 8, all of said washers being arranged in series with one another, or all of said washers being arranged in parallel with one another.

10. The railcar end unit as claimed in claim 8, a first plurality of said washers being arranged in series with one another and a second plurality of said washers being arranged in parallel with one another.

11. The railcar end unit as claimed in claim 5, said buff end body including a buff follower body configured to engage the buff sill stop, said draft end body including a yoke and a draft follower body shiftably received by the yoke, with the draft follower body configured to engage the draft sill stop.

12. The railcar end unit as claimed in claim 5, said buff spring pack being operably coupled to at least one of the end bodies, said buff spring pack presenting an axial length which is reduced when the buff spring pack is compressed so as to permit the end bodies to move toward one another along an axial buff travel dimension, said buff travel dimension ranging from about ten inches to about eighteen inches.

13. The railcar end unit as claimed in claim 5, said railcar end unit being devoid of pressurized fluid.

14. A railcar end unit operable to be mounted in a center sill between buff and draft sill stops to interconnect the center sill and a coupler, with the coupler being shiftable from a neutral condition to a buff condition, in response to a buff event, and from the neutral condition to a draft condition, in response to a draft event, said railcar end unit comprising:

buff and draft end bodies configured to be shiftably mounted in the center sill to engage respective sill stops and to shift axially relative to one another along a unit axis, said draft end body being configured to connect to the coupler;

a buff spring pack and a draft spring pack each being operably coupled to at least one of the end bodies, at least said buff spring pack being axially compressed along the unit axis when the coupler is in the buff condition to urge the coupler toward the neutral condition, at least said draft spring pack being resiliently compressed along the unit axis when the coupler is in the draft condition to urge the coupler toward the neutral condition, said buff spring pack presenting an axial length which is reduced when the buff spring pack is compressed so as to permit the end bodies to move toward one another along an axial buff travel dimension, said buff travel dimension ranging from about ten inches to about eighteen inches, said buff spring pack including a buff spring component and a buff cushioning component, said buff spring component including a plurality of axially arranged disc springs, each of said components operably arranged between the end bodies so as to be resiliently compressed, said components being at least in part axially coextensive so as to be simultaneously compressible, said buff cushioning component including a plurality of axially arranged cushioning discs primarily dimensioned and configured to dissipate energy, said components being generally coaxially arranged, with one of the components being received in the other one of the components, said components cooperatively defining an axially extending interface along which the components are adjacent one another, said buff cushioning component including a sleeve that is relatively harder than the cushioning discs, said sleeve being located along the interface so as to separate the cushioning discs from the disc springs.

15. The railcar end unit as claimed in claim 14, said draft spring pack including a draft spring component, said draft spring component including another plurality of axially arranged disc springs.

16. The railcar end unit as claimed in claim 15, said buff spring component being dimensioned and configured to urge the end bodies apart from one another.

17. The railcar end unit as claimed in claim 15, each of said disc springs comprising a non-flat, metallic disc spring.

18. The railcar end unit as claimed in claim 17, each of said disc springs comprising a frusto-conical spring washer.

19. The railcar end unit as claimed in claim 18, all of said washers being arranged in series with one another, or all of said washers being arranged in parallel with one another.

20. The railcar end unit as claimed in claim 18, a first plurality of said washers being arranged in series with one another and a second plurality of said washers being arranged in parallel with one another.

21. The railcar end unit as claimed in claim 15, said disc springs being resiliently compressed in the neutral condition so that the buff and draft spring components are preloaded.

22. The railcar end unit as claimed in claim 15, said draft end body including a yoke and a draft follower body, said yoke being configured to be engaged by the coupler and shiftably receiving the draft follower body and the draft spring component, with part of the yoke located between the buff and draft spring components, said yoke being shiftable toward the buff end body from a neutral position to a buff position during a buff event, said yoke being shiftable toward the draft follower body from the neutral position to a draft position during a draft event.

23. The railcar end unit as claimed in claim 14, said railcar end unit being devoid of pressurized fluid.

* * * * *